US008491410B2

(12) United States Patent
Kato

(10) Patent No.: US 8,491,410 B2
(45) Date of Patent: Jul. 23, 2013

(54) GOLF CLUB SHAFT

(75) Inventor: Masatoshi Kato, Kobe (JP)

(73) Assignee: SRI Sports Limited, Kobe (JP)

( * ) Notice: Subject to any disclaimer, the term of this patent is extended or adjusted under 35 U.S.C. 154(b) by 45 days.

(21) Appl. No.: 13/311,249

(22) Filed: Dec. 5, 2011

(65) Prior Publication Data

US 2012/0165113 A1 Jun. 28, 2012

(30) Foreign Application Priority Data

Dec. 22, 2010 (JP) ..... 2010-285456

(51) Int. Cl.
*A63B 53/10* (2006.01)

(52) U.S. Cl.
USPC ..... 473/319

(58) Field of Classification Search
USPC ..... 473/319
See application file for complete search history.

(56) References Cited

U.S. PATENT DOCUMENTS

| | | | | |
|---|---|---|---|---|
| 6,106,413 | A | 8/2000 | Kusumoto | |
| 6,306,047 | B1 * | 10/2001 | Kusumoto | 473/319 |
| 6,524,195 | B1 | 2/2003 | Kusumoto | |
| 2004/0192462 | A1 * | 9/2004 | Ashida et al. | 473/319 |
| 2007/0117647 | A1 * | 5/2007 | Nakajima | 473/316 |
| 2009/0264216 | A1 * | 10/2009 | Kato | 473/319 |
| 2010/0317456 | A1 * | 12/2010 | Kato | 473/319 |

FOREIGN PATENT DOCUMENTS

| | | | |
|---|---|---|---|
| JP | 11-206934 | A | 8/1999 |

* cited by examiner

*Primary Examiner* — Michael Dennis
(74) *Attorney, Agent, or Firm* — Birch, Stewart, Kolasch & Birch, LLP

(57) ABSTRACT

A shaft 6 has layers. The layers include a straight layer in which an absolute angle θa of a fiber to a shaft axis line is 10 degrees or less, a bias layer in which the angle θa is 30 degrees or greater and 60 degrees or less, and a hoop layer in which the angle θa is 80 degrees or greater. The layers include full length layers and a partial layer. The full length layers include full length bias layers and full length straight layers. The full length bias layers are located on the innermost side among the full length layers. The full length layer brought into contact with a low RC full length layer outside the full length bias layers is a high RC layer. The full length layer brought into contact with an outer surface of the full length bias layers is a high RC layer.

11 Claims, 13 Drawing Sheets

GOLF CLUB SHAFT

The present application claims priority on Patent Application No. 2010-285456 filed in JAPAN on Dec. 22, 2010, the entire contents of which are hereby incorporated by reference.

BACKGROUND OF THE INVENTION

1. Field of the Invention

The present invention relates to a golf club shaft.

2. Description of the Related Art

A so-called carbon shaft has been known as a golf club shaft. A sheet winding method has been known as a method for manufacturing the carbon shaft. In the sheet winding method, a laminated structure is obtained by winding a prepreg (prepreg sheet) around a mandrel. In the sheet winding method, the type of a sheet, the disposal of the sheet, and the orientation of a fiber can be selected. Therefore, a high degree of freedom in design is obtained.

The prepreg includes a resin and a fiber. Many types of prepregs exist. A plurality of prepregs having different resin contents has been known. In the present application, the prepreg is also referred to as a prepreg sheet or a sheet.

In a tubular body described in Japanese Patent Application Publication No. 3235964 (U.S. Pat. No. 6,106,413, U.S. Pat. No. 6,524,195), a prepreg having a synthetic resin impregnating amount of 10% by weight or greater and less than 25% by weight is used as a skew fiber body layer and an axial fiber body layer. In this invention, a thin layer having a great synthetic resin impregnating amount is formed between the skew fiber body layer and the axial fiber body layer.

Japanese Patent Application Laid-Open No. 11-206934 discloses a shaft including an axially elongated fiber layer and an oblique fiber layer. At least one of the axially elongated fiber layer and the oblique fiber layer includes a prepreg having a low resin impregnating amount of 10 to 24% by weight. A layer including a prepreg having a high resin impregnating amount of 10% by weight or higher than that of the prepreg is formed on the inner and outer layer sides of a layer formed by the prepreg.

SUMMARY OF THE INVENTION

A prepreg having a low resin content can contribute to weight saving of a shaft. However, since the prepreg having a low resin content has low tacking property (tackiness, easiness of adhesion), it is difficult to stick a sheet end part (perform end sticking). For this reason, wrinkles and deviation are apt to be generated in a winding process. Furthermore, the sheet is apt to be peeled after winding. These problems may cause reduction in productivity, generation of voids, and strength reduction or the like.

Since the prepreg having a low resin content has a less resin existing between fibers, the prepreg is apt to split. The splitting is generated along a fiber direction. Particularly, when the sheet is wound by a rolling machine, the sheet is apt to be split.

Interlayer peeling is apt to be generated in the prepreg having a low resin content. The interlayer peeling may reduce shaft strength.

It is an object of the present invention to provide a lightweight golf club shaft having excellent strength.

A golf club shaft of the present invention has a plurality of layers. The layers include a straight layer in which an absolute angle θa of a fiber to a shaft axis line is equal to or less than 10 degrees, a bias layer in which the angle θa is 30 degrees or greater and 60 degrees or less, and a hoop layer in which the angle θa is equal to or greater than 80 degrees. The layers include full length layers disposed all over in a longitudinal direction of a shaft, and a partial layer partially disposed in the longitudinal direction of the shaft. The full length layers include full length bias layers as the bias layer, and full length straight layers as the straight layer. The full length bias layers are located on the innermost side among the full length layers. The full length layer brought into contact with a low RC full length layer outside the full length bias layers is a high RC layer. The full length layer brought into contact with an outer surface of the full length bias layers is a high RC layer. The high RC layer is a layer formed by a prepreg having a resin content equal to or greater than 24% by mass. The low RC layer is a layer formed by a prepreg having a resin content equal to or less than 20% by mass.

Preferably, all the full length bias layers are the low RC layers.

Preferably, a resin content of at least one layer of the full length straight layers is lower than a resin content of the full length bias layers.

Preferably, a ratio of the low RC layer is equal to or greater than 50% by mass based on a mass of the shaft.

Preferably, a mass of the shaft is equal to or less than 45 g.

Preferably, the shaft is formed using a high-low united sheet obtained by attaching a low RC prepreg with a high RC prepreg.

Preferably, the high-low united sheet is wound with the high RC prepreg set to the inside.

Preferably, the low RC prepreg forms the straight layer, and the high RC prepreg forms the hoop layer.

A lightweight golf club shaft having excellent strength can be obtained in the present invention.

BRIEF DESCRIPTION OF THE DRAWINGS

FIG. 2 is also a developed view of example 1;

FIG. 3 is also a developed view of example 1;

DESCRIPTION OF THE PREFERRED EMBODIMENTS

Hereinafter, the present invention will be described in detail based on the preferred embodiments with appropriate references to the drawings.

The term "layer" and the term "sheet" are used in the present application. The "layer" is termed after being wound. On the other hand, the "sheet" is termed before being wound. The "layer" is formed by winding the "sheet". That is, the wound "sheet" forms the "layer".

In the present application, an "inside" means an inside in a radial direction of a shaft. In the present application, an "outside" means an outside in the radial direction of the shaft.

Figure 1:
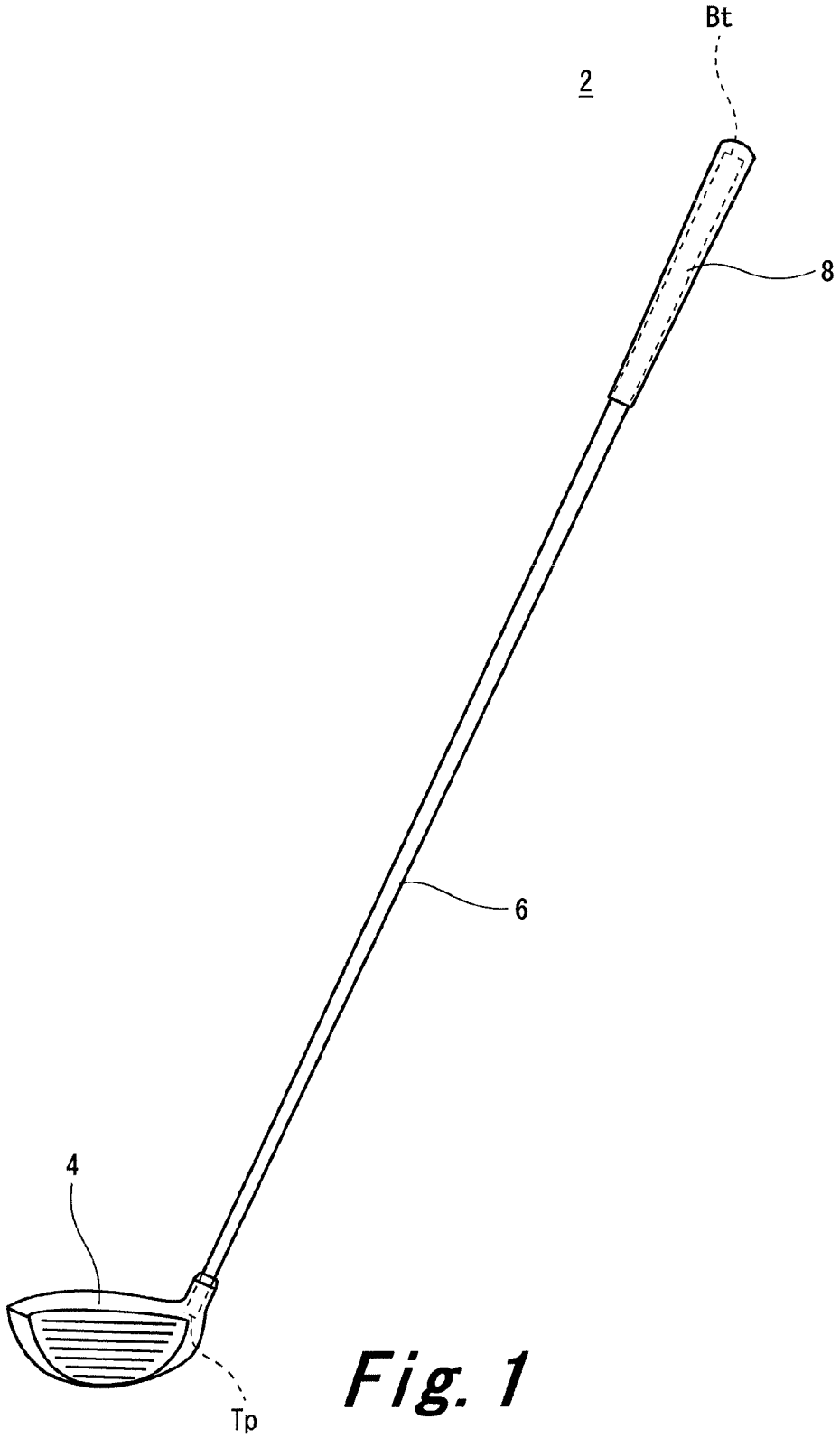
FIG. 1 shows a golf club provided with a shaft according to an embodiment of the present invention.

FIG. 1 is an overall view of a golf club 2 provided with a golf club shaft 6 according to an embodiment of the present invention. The golf club 2 is provided with a head 4, a shaft 6, and a grip 8. The head 4 is provided at the tip part of the shaft 6. The grip 8 is provided at the butt end part of the shaft 6. The head 4 and the grip 8 are not restricted. Examples of the head 4 include a wood type golf club head, an iron type golf club head, and a putter head.

Figure 4:
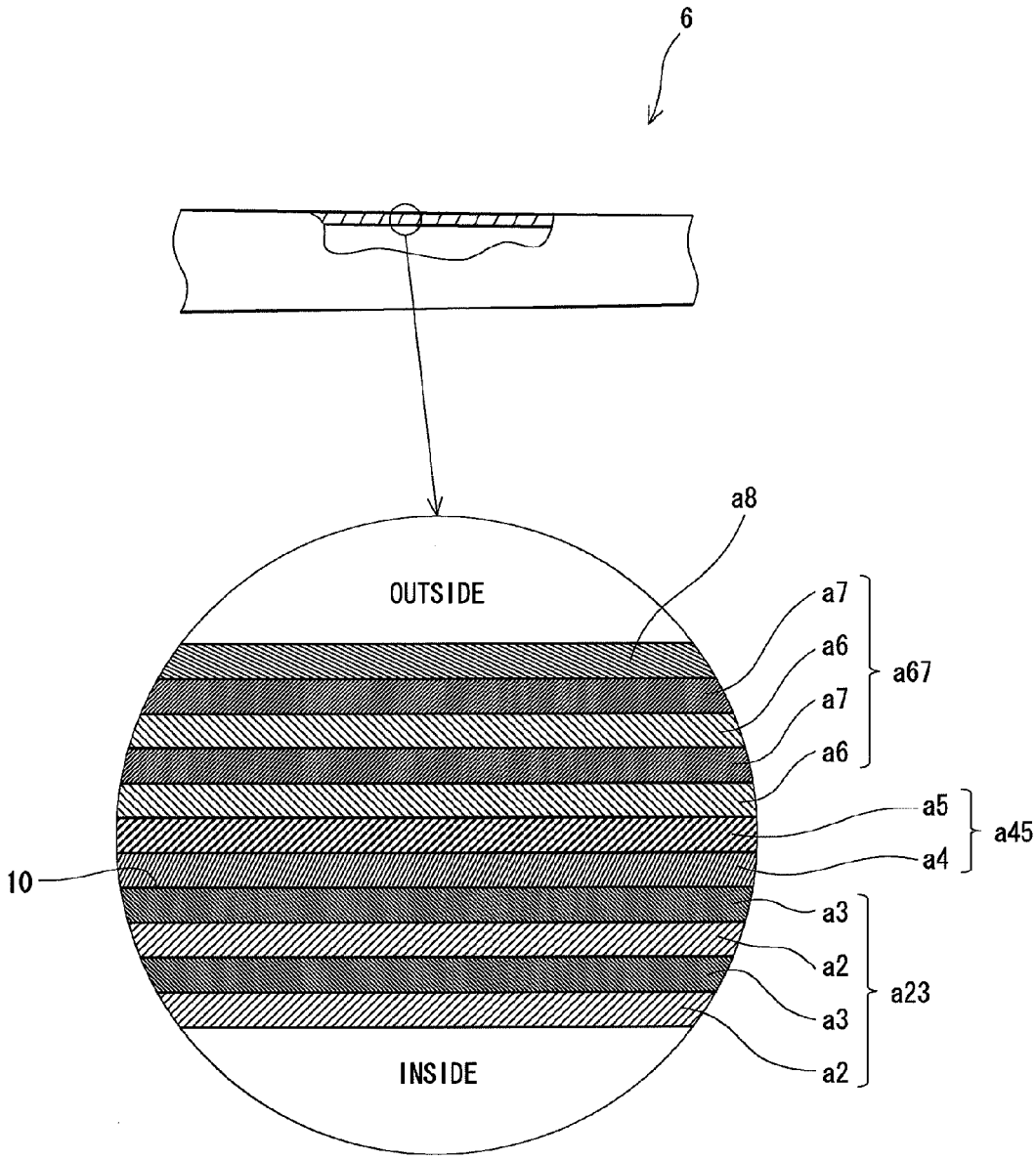
FIG. 4 is a cross sectional view of a shaft according to the first embodiment.

The shaft 6 includes a laminate of fiber reinforced resin layers. The shaft 6 is a tubular body. As shown in FIG. 4 to be described later, the shaft 6 has a hollow structure. As shown in FIG. 1, the shaft 6 has a tip Tp and a butt Bt. The tip Tp is located inside the head 4. The butt Bt is located inside the grip 8.

The shaft 6 is a so-called carbon shaft. The shaft 6 is preferably produced by curing the prepreg sheet. In this prepreg sheet, a fiber is oriented substantially in one direction. Thus, the prepreg in which the fiber is oriented substantially in one direction is also referred to as a UD prepreg. The term "UD" stands for uni-direction. Prepregs other than the UD prepreg may be used. For example, fibers contained in the prepreg sheet may be woven.

The prepreg sheet has a fiber and a resin. The resin is also referred to as a matrix resin. The fiber is typically a carbon fiber. The matrix resin is typically a thermosetting resin.

The shaft 6 is preferably manufactured by a so-called sheet winding method. In the prepreg, the matrix resin is in a semicured state. The shaft 6 is obtained by winding and curing the prepreg sheet. The curing means the curing of the semicured matrix resin. The curing is attained by heating. The manufacturing process of the shaft 6 includes a heating process. The matrix resin of the prepreg sheet is cured in the heating process.

Figure 2:
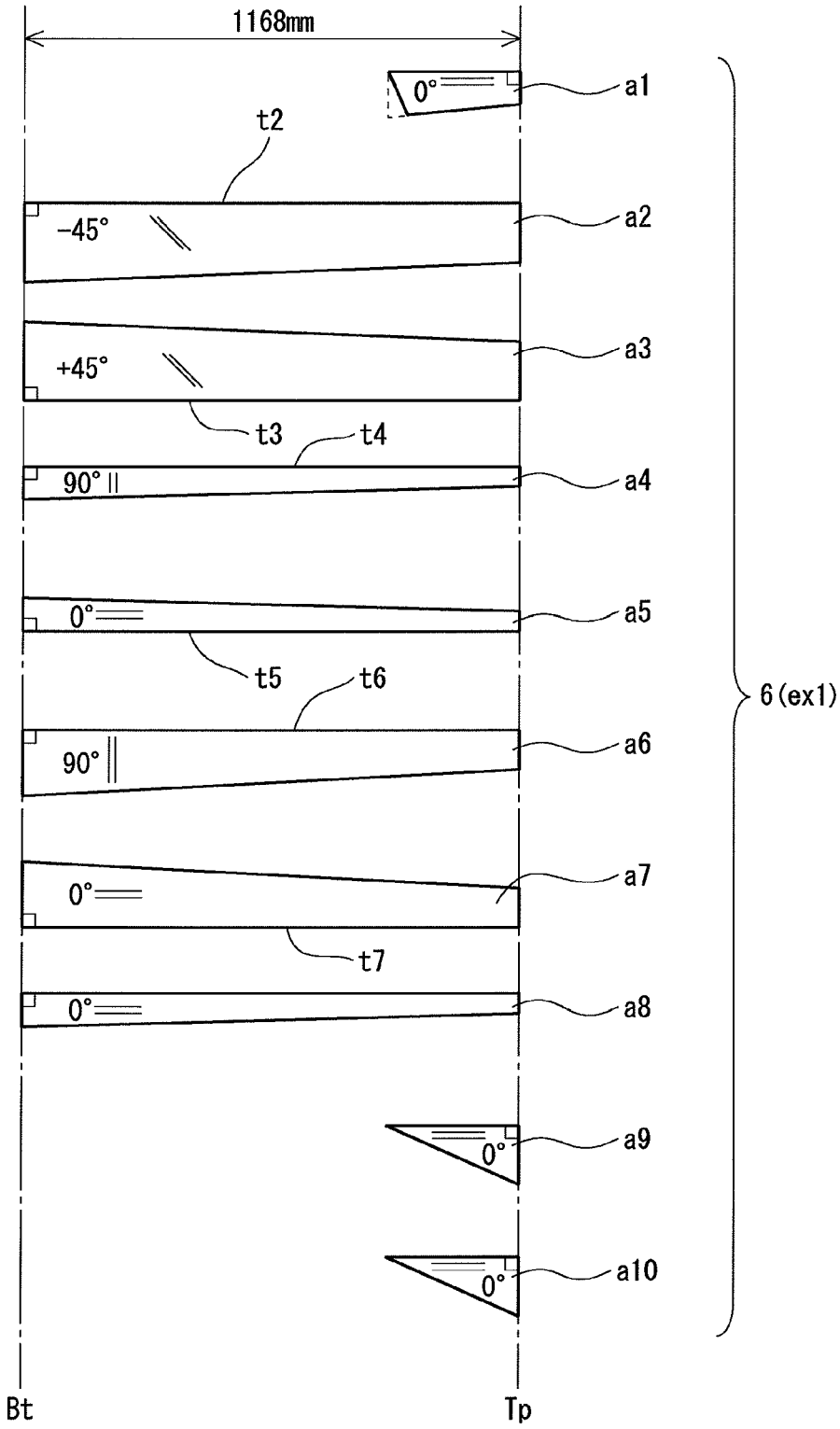
FIG. 2 is a developed view of a first embodiment.

FIG. 2 is a developed view (sheet constitution view) of the prepreg sheets constituting the shaft 6. The shaft 6 includes a plurality of sheets. In the embodiment of FIG. 2, the shaft 6 includes ten sheets a1 to a10. In the present application, the developed view shown in FIG. 2 or the like shows the sheets constituting the shaft in order from the radial inner side of the shaft. The sheets are wound in order from the sheet located above in the developed view. In the developed view of the present application, the horizontal direction of the figure coincides with the axial direction of the shaft. In the developed view of the present application, the right side of the figure is the tip Tp side of the shaft. In the developed view of the present application, the left side of the figure is the butt Bt side of the shaft.

The developed view of the present application shows not only the winding order of each of the sheets but also the arrangement of each of the sheets in the axial direction of the shaft. For example, in FIG. 2, one end of the sheet a1 is located at the tip Tp.

The shaft 6 has a straight layer and a bias layer. The orientation angle of the fiber is described in the developed view of the present application. A sheet described as "0 degree" constitutes the straight layer. The sheet for the straight layer is also referred to as a straight sheet in the present application.

The straight layer is a layer in which the orientation direction of the fiber is substantially 0 degree to the longitudinal direction (axial direction) of the shaft. Usually, the orientation direction of the fiber is not completely parallel to the axial direction of the shaft because of error or the like in winding. In the straight layer, an absolute angle θa of the fiber to a shaft axis line is equal to or less than 10 degrees. The absolute angle θa is an absolute value of an angle between the shaft axis line and the direction of the fiber. That is, the absolute angle θa equal to or less than 10 degrees means that an angle Af between the direction of the fiber and the axial direction of the shaft is −10 degrees or greater and +10 degrees or less.

In the embodiment of FIG. 2, the straight sheets are the sheet a1, the sheet a5, the sheet a7, the sheet a8, the sheet a9, and the sheet a10. The straight layer is highly correlated with the flexural rigidity and flexural strength of the shaft.

The bias layer is mainly provided in order to enhance the torsional rigidity and torsional strength of the shaft.

Preferably, the bias layer includes a pair of sheets in which the orientation directions of the fibers are inclined in opposite directions to each other. Preferably, the bias layer includes a layer having the angle Af of −60 degrees or greater and −30 degrees or less and a layer having the angle Af of 30 degrees or greater and 60 degrees or less. That is, preferably, the absolute angle θa in the bias layer is 30 degrees or greater and 60 degrees or less.

In the shaft 6, the sheets constituting the bias layer are the sheet a2 and the sheet a3. In FIG. 2, the angle Af is described in each sheet. The plus (+) and minus (−) in the angle Af show that the fibers of bias sheets attached to each other are inclined in opposite directions to each other. In the present application, the sheet for the bias layer is also referred to as a bias sheet.

In the embodiment of FIG. 2, the angle of the sheet a2 is −45 degrees and the angle of the sheet a3 is +45 degrees. It should be appreciated, however, that the angle of the sheet a2 may be +45 degrees and the angle of the sheet a3 may be −45 degrees.

Preferably, a hoop layer may be provided other than the straight layer and the bias layer. In the hoop layer, the absolute angle θa is equal to or greater than 80 degrees. The upper limit value of the absolute angle θa is 90 degrees.

Preferably, the absolute angle θa in the hoop layer is substantially 90 degrees to a shaft axis line. However, usually, the orientation direction of the fiber to the axial direction of the shaft is not completely set to 90 degrees because of error or the like in winding.

The hoop layer contributes to enhancement of the crushing rigidity and crushing strength of the shaft. The crushing rigidity is rigidity to a force crushing the shaft toward the inner side in the radial direction thereof. The crushing strength is strength to a force crushing the shaft toward the inner side in the radial direction thereof. The crushing strength can be also involved with the flexural strength. Crushing deformation can be interlocked with flexural deformation. In a particularly thin lightweight shaft, this interlocking property is large. The enhancement of the crushing strength also causes the enhancement of the flexural strength.

In the embodiment of FIG. 2, the prepreg sheets for the hoop layer are a sheet a4 and a sheet a6. In the present application, the prepreg sheet for the hoop layer is also referred to as a hoop sheet.

Although not shown in the drawings, the prepreg sheet before being used is sandwiched between cover sheets. The cover sheets are usually a release paper and a resin film. That is, the prepreg sheet before being used is sandwiched between the release paper and the resin film. The release paper is laminated on one surface of the prepreg sheet, and the resin film is laminated on the other surface of the prepreg sheet. Hereinafter, the surface on which the release paper is laminated is also referred to as "the surface of a release paper side", and the surface on which the resin film is laminated is also referred to as "the surface of a film side".

In the developed view of the present application, the surface of the film side is the front side. That is, in the developed view of the present application, the front side of the figure is the surface of the film side, and the back side of the figure is the surface of the release paper side. For example, in FIG. 2, the direction of the fiber of the sheet a2 is the same as that of the sheet a3. However, in the case of the laminating to be described later, the sheet a3 is reversed. As a result, the directions of the fibers of the sheets a2 and a3 are opposite to each other. Therefore, in the state after being wound, the directions of the fibers of the sheets a2 and a3 are opposite to each other. In light of this point, in FIG. 2, the fibrous direction of the sheet a2 is described as "−45 degrees", and the fibrous direction of the sheet a3 is described as "+45 degrees".

In order to wind the prepreg sheet, the resin film is first peeled. The surface of the film side is exposed by peeling the resin film. The exposed surface has tacking property (tackiness). The tacking property is caused by the matrix resin. That is, since the matrix resin is in a semicured state, the tackiness is developed. Next, the edge part of the exposed surface of the film side (also referred to as a winding start end part) is stuck on a wound object. The winding start end part can be smoothly stuck by the tackiness of the matrix resin. The wound object is a mandrel or a wound article obtained by winding the other prepreg sheet around the mandrel. Next, the release paper is peeled. Next, the wound object is rotated to wind the prepreg sheet around the wound object. Thus, the resin film is first peeled. Next, the winding start end part is stuck on the wound object, and the release paper is then peeled. Thus, after the resin film is first peeled, and the winding start end part is stuck on the wound object, the release paper is peeled. The procedure suppresses wrinkles and winding fault of the sheet. This is because the sheet on which the release paper is stuck is supported by the release paper, and hardly causes wrinkles. The release paper has flexural rigidity higher than that of the resin film.

An united sheet is used in the embodiment of FIG. 2. The united sheet is formed by attaching one sheet with another sheet.

Figure 3:
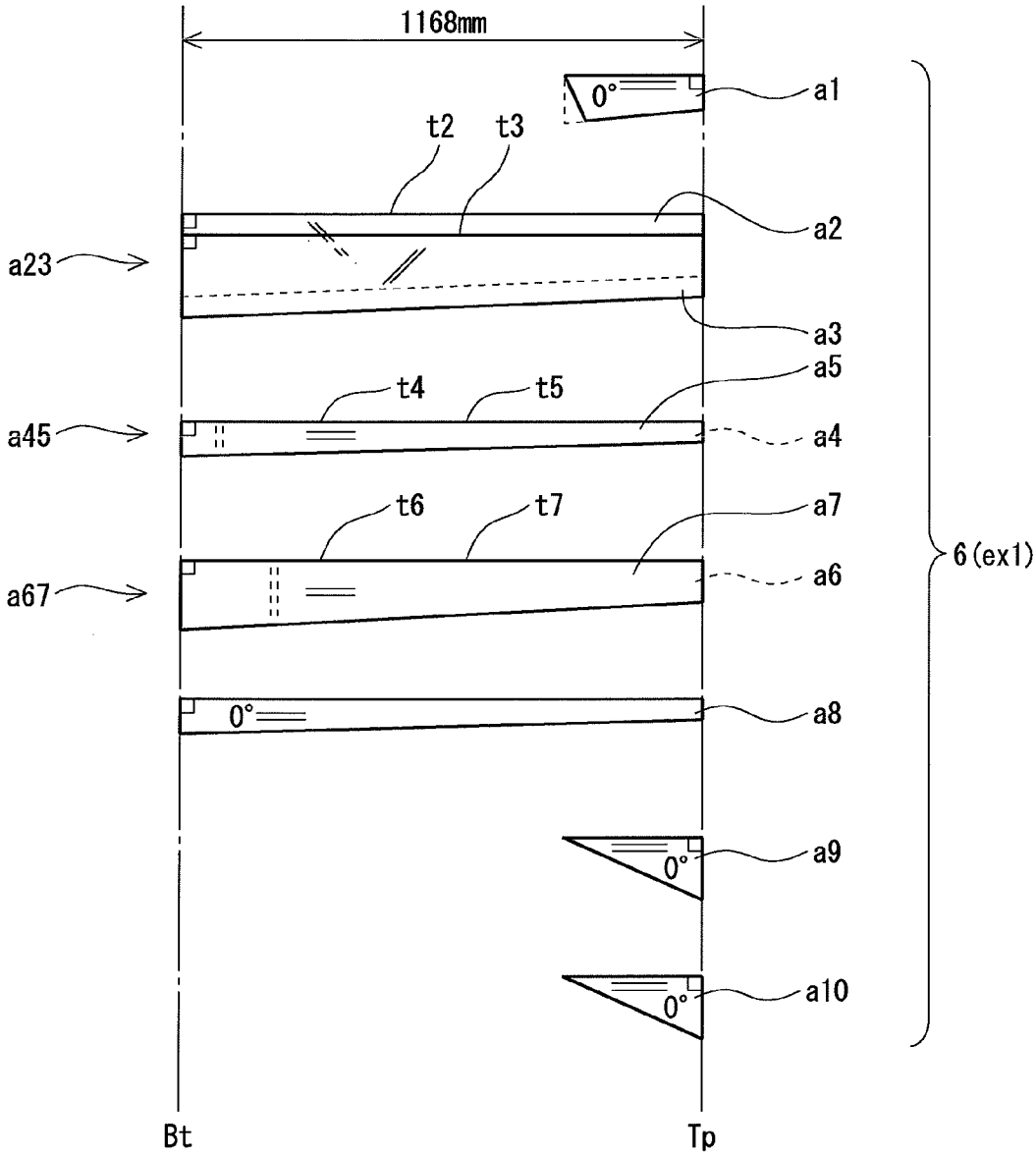
FIG. 3 is a developed view of a first embodiment after an united sheet is produced.

Three united sheets are formed in the embodiment of FIG. 2. FIG. 3 shows a sheet constitution after the three united sheets are formed.

As shown in FIG. 3, the sheet a2 and the sheet a3 are laminated, to form an united sheet a23. In the united sheet a23, a laminating end part t2 of the sheet a2 and a laminating end part t3 of the sheet a3 are deviated for a half circle. That is, in the section of the shaft after being wound, the circumferential position of the end part t2 and the circumferential position of the end part t3 are different from each other by 180 degrees.

As shown in FIG. 3, the sheet a4 and the sheet a5 are laminated, to form an united sheet a45. In the united sheet a45, a laminating end part t4 of the sheet a4 and a laminating end part t5 of the sheet a5 coincide with each other. That is, in the section of the shaft after being wound, the circumferential position of the end part t4 and the circumferential position of the end part t5 coincide with each other.

As shown in FIG. 3, the sheet a6 and the sheet a7 are laminated, to form an united sheet a67. In the united sheet a67, a laminating end part t6 of the sheet a6 and a laminating end part t7 of the sheet a7 coincide with each other. That is, in the section of the shaft after being wound, the circumferential position of the end part t6 and the circumferential position of the end part t7 coincide with each other.

As described above, in the present application, the sheet and the layer are classified by the orientation angle of the fiber. In addition to the orientation angle, in the present application, the sheet and the layer are classified by the length of the shaft in the longitudinal direction.

In the present application, a layer disposed all over in the longitudinal direction of the shaft is referred to as a full length layer. In the present application, a sheet disposed all over in the longitudinal direction of the shaft is referred to as a full length sheet. The wound full length sheet forms the full length layer.

On the other hand, in the present application, a layer partially disposed in the longitudinal direction of the shaft is referred to as a partial layer. In the present application, a sheet partially disposed in the longitudinal direction of the shaft is referred to as a partial sheet. The wound partial sheet forms a partial layer.

In the present application, the full length layer which is the bias layer is referred to as a full length bias layer. In the present application, the full length layer which is the straight layer is referred to as a full length straight layer. In the present application, the full length layer which is the hoop layer is referred to as a full length hoop layer.

In the present application, the partial layer which is the bias layer is referred to as a partial bias layer. In the present application, the partial layer which is the straight layer is referred to as a partial straight layer. In the present application, the partial layer which is the hoop layer is referred to as a partial hoop layer.

In the present application, the sheet and the layer are also classified by a resin content.

In the present application, the high RC layer is a layer formed by a prepreg (sheet) having a resin content equal to or greater than 24% by mass. A part of the matrix resin may flow out in a curing process to be described later. The outflow may cause the high RC layer having a resin content of less than 24% by mass in the completed shaft.

In the present application, the low RC layer is a layer formed by a prepreg (sheet) having a resin content equal to or less than 20% by mass.

In the present application, the high RC prepreg is a prepreg sheet having a resin content equal to or greater than 24% by mass. In the present application, the high RC prepreg is also referred to as a high RC sheet. In the present application, the low RC prepreg is a prepreg sheet having a resin content equal to or less than 20% by mass. In the present application, the low RC prepreg is also referred to as a low RC sheet. In the present application, the high RC layer is a layer formed by the high RC prepreg. In the present application, the low RC layer is a layer formed by the low RC prepreg.

When commercially available prepregs are used, these resin contents are values reported by prepreg manufacturers. The resin contents are described in the catalogs of the prepreg manufacturers, and are widely known by those skilled in the art.

In the present application, an united sheet obtained by laminating a high RC prepreg and a low RC prepreg is referred to as a high-low united sheet.

In the embodiment of FIG. 2 (FIG. 3), the low RC prepregs are a sheet a2, a sheet a3, a sheet a5, and a sheet a7. On the other hand, in the embodiment of FIG. 2 (FIG. 3), the high RC prepregs are a sheet a1, a sheet a4, a sheet a6, a sheet a8, a sheet a9, and a sheet a10. Therefore, the united sheet a45 is a high-low united sheet, and the united sheet a67 is also a high-low united sheet.

In the embodiment of FIG. 2 (FIG. 3), all the hoop sheets are the high RC sheets. In the embodiment of FIG. 2 (FIG. 3), all the hoop sheets are laminated on the low RC sheet and wound. In the embodiment, all the low RC sheets are laminated on the high RC sheet and wound. In the embodiment, all the low RC sheets except the bias sheet are the straight sheets.

The embodiment of FIG. 2 (FIG. 3) includes a full length hoop layer (full length hoop sheet). All the full length hoop layers are the high RC layers. All the full length hoop layers are laminated on the full length straight layer and wound.

Hereinafter, a manufacturing process of the shaft 6 will be schematically described.

[Outline of Manufacturing Process of Shaft]

(1) Cutting Process

The prepreg sheet is cut into a desired shape in the cutting process. Each of the sheets shown in FIG. 2 is cut out in the process.

The cutting may be performed by a cutting machine, or may be manually performed. In the manual case, for example, a cutter knife is used.

(2) Laminating Process (Attaching Process)

A plurality of sheets is laminated in the laminating process, to produce the above-mentioned united sheet.

In the laminating process, heating or a press may be used. More preferably, the heating and the press is used in combination.

In a winding process to be described later, the deviation between the sheets may be produced during the winding operation of the united sheet. The deviation reduces winding accuracy. The heating and the press improve an adhesive force between the sheets. The heating and the press suppress the deviation between the sheets in the winding process.

In respect of enhancing the adhesive force between the sheets, a heating temperature in the laminating process is preferably equal to or greater than 30° C., and more preferably equal to or greater than 35° C. When the heating temperature is too high, the curing of the matrix resin may be progressed, to reduce the tackiness of the sheet. The reduction of the tackiness reduces adhesion between the united sheet and the wound object. The reduction of the adhesion may allow the generation of wrinkles, to produce the deviation of a winding position. In this respect, the heating temperature in the laminating process is preferably equal to or less than 60° C., more preferably equal to or less than 50° C., and still more preferably equal to or less than 40° C.

In respect of enhancing the adhesive force between the sheets, a heating time in the laminating process is preferably equal to or greater than 20 seconds, and more preferably equal to or greater than 30 seconds. In respect of the tackiness of the sheet, the heating time in the laminating process is preferably equal to or less than 300 seconds.

In respect of enhancing the adhesive force between the sheets, a press pressure in the laminating process is preferably equal to or greater than 300 g/cm$^2$, and more preferably equal to or greater than 350 g/cm$^2$. When the press pressure is excessive, the prepreg may be crushed. In this case, the thickness of the prepreg is made thinner than a designed value. In respect of thickness accuracy of the prepreg, the press pressure in the laminating process is preferably equal to or less than 600 g/cm$^2$, and more preferably equal to or less than 500 g/cm$^2$.

In respect of enhancing the adhesive force between the sheets, a press time in the laminating process is preferably equal to or greater than 20 seconds, and more preferably equal to or greater than 30 seconds. In respect of the thickness accuracy of the prepreg, the press time in the laminating process is preferably equal to or less than 300 seconds.

The united sheet a23 is an united sheet obtained by laminating the bias sheets. In the present application, the united sheet is also referred to as a bias united sheet. The united sheet a45 is an united sheet obtained by laminating the straight sheet and the hoop sheet. The united sheet is also referred to as an SF united sheet in the present application. The united sheet a67 is also an united sheet obtained by laminating the straight sheet and the hoop sheet, that is, the SF united sheet.

(3) Winding Process

A mandrel is prepared in the winding process. A typical mandrel is made of a metal. A release agent is applied to the mandrel. Furthermore, a resin having tackiness is applied to the mandrel. The resin is also referred to as a tacking resin. The cut sheet is wound around the mandrel. The tacking resin facilitates the sticking of the sheet end part on the mandrel.

The sheet related to the lamination is wound in a state of the united sheet. That is, each of the sheets having a state of FIG. 3 is wound.

A winding body is obtained by the winding process. The winding body is obtained by wrapping the prepreg sheet around the outside of the mandrel. For example, the winding is performed by rolling the wound object on a plane. The winding may be performed by a manual operation or a machine. The machine is referred to as a rolling machine.

(4) Tape Wrapping Process

A tape is wrapped around the outer peripheral surface of the winding body in the tape wrapping process. The tape is also referred to as a wrapping tape. The wrapping tape is wrapped while tension is applied to the wrapping tape. A pressure is applied to the winding body by the wrapping tape. The pressure reduces voids.

(5) Curing Process

In the curing process, the winding body after performing the tape wrapping is heated. The heating cures the matrix resin.

In the curing process, the matrix resin fluidizes temporarily. The fluidization of the matrix resin can discharge air between the sheets or in the sheet. The pressure (fastening force) of the wrapping tape accelerates the discharge of the air. The curing provides a cured laminate.

(6) Process of Extracting Mandrel and Process of Removing Wrapping Tape

The process of extracting the mandrel and the process of removing the wrapping tape are performed after the curing process. The order of the both processes is not restricted. However, the process of removing the wrapping tape is preferably performed after the process of extracting the mandrel in respect of improving the efficiency of the process of removing the wrapping tape.

(7) Process of Cutting Both Ends

The both end parts of the cured laminate are cut in the process. The cutting flattens the end face of the tip Tp and the end face of the butt Bt.

(8) Polishing Process

The surface of the cured laminate is polished in the process. Spiral unevenness left behind as the trace of the wrapping tape exists on the surface of the cured laminate. The polishing extinguishes the unevenness as the trace of the wrapping tape to flatten the surface of the cured laminate.

(9) Coating Process

The cured laminate after the polishing process is subjected to coating.

The shaft 6 having a sheet constitution shown in FIGS. 2 and 3 and manufactured in the process has a laminated structure shown in FIG. 4. FIG. 4 shows a cross sectional view of the shaft 6 at a position where the partial layer is not disposed. The cross sectional view is a cross sectional view taken along the shaft axis line.

In the present application, the same reference numerals are used in the layer and the sheet. For example, a layer formed by a sheet a1 is defined as a layer a1.

In the shaft 6, the full length layers are a layer a2, a layer a3, a layer a4, a layer a5, a layer a6, a layer a7, and a layer a8. The layer a2 and the layer a3 are the full length bias layers. The layer a4 is the full length hoop layer. The layer a5 is the full length straight layer. The layer a6 is the full length hoop layer. The layer a7 and the layer a8 are the full length straight layers. On the other hand, in the shaft 6, the partial layers are a layer a1, a layer a9, and a layer a10.

The layer a4 (sheet a4) is set to be one ply. That is, the winding number of the layer a4 (sheet a4) is 1. The layer a5 is set to be one ply. The layer a6 is set to be two plies. The layer a7 is set to be two plies. The layer a8 is set to be one ply.

The sheet a4 and the sheet a5 are wound as the united sheet a45. The united sheet a45 is wound with the sheet a4 set to the inside. That is, the united sheet a45 is wound with the sheet a4 having a resin content higher than the laminated sheet a5 set to the inside. The united sheet a45 is obtained by laminating the high RC sheet a4 and the low RC sheet a5. The high-low united sheet a45 is wound with the high RC sheet a4 set to the inside. End sticking is facilitated by setting the sheet having a higher resin content to the inside, and winding fault tend not to occur.

The sheet a6 and the sheet a7 are wound as the united sheet a67. The united sheet a67 is wound with the sheet a6 set to the inside. That is, the united sheet a67 is wound with the sheet a6 having a resin content higher than the laminated sheet a7 set to the inside. The united sheet a67 is obtained by laminating the high RC sheet a6 and the low RC sheet a7. The high-low united sheet a67 is wound with the high RC sheet a6 set to the inside. End sticking is facilitated by setting the sheet having a higher resin content to the inside, and winding fault is hard to produce.

The sheet a6 and the sheet a7 are set to be two plies. Since the sheet a6 and the sheet a7 are wound in the state of the united sheet a67, as shown in FIG. 4, the layer a6 and the layer a7 are alternately disposed.

In the shaft 6, the full length bias layers a2 and a3 are located on the innermost side among the full length layers. Since the full length bias layers a2 and a3 are wound in the state of the united sheet a23, the layer a2 and the layer a3 are alternately disposed in the cross sectional view of FIG. 4. A layer wound in the state of the united sheet a23 is also referred to as a layer a23.

The shaft 6 satisfies the following constitution X. [Constitution X]: The full length layer brought into contact with the low RC full length layer outside the full length bias layer (layer a23) is the high RC layer.

Specifically, the high RC full length layer a4 and the high RC full length layer a6 are brought into contact with the low RC full length layer a5. The high RC full length layer a6 and the high RC full length layer a8 are brought into contact with the low RC full length layer a7 (see FIG. 4). The constitution X is satisfied in all the low RC full length layers.

Only the full length layer is considered in the constitution X.

The constitution X facilitates the end sticking in the winding process, to suppress the deviation of the winding. Therefore, the constitution X can suppress the winding fault in the presence of the low RC layer, to enhance productivity. The constitution X suppresses interlayer peeling, to enhance shaft strength. A lightweight shaft having high strength can be obtained in the constitution X.

The constitution X may be partially satisfied in the longitudinal direction of the shaft. The constitution X is preferably satisfied allover in the longitudinal direction of the shaft. The constitution X may be partially satisfied in the circumferential direction of the shaft. The constitution X may be satisfied all over in the circumferential direction of the shaft. In the shaft 6, the constitution X is satisfied all over in the longitudinal direction of the shaft, and is satisfied all over in the circumferential direction of the shaft.

The shaft 6 satisfies the following constitution Y.

[Constitution Y]: The full length layer brought into contact with the outer surface of the full length bias layer (layer a23) is the high RC layer.

Specifically, the high RC full length layer a4 is brought into contact with an outer surface 10 of the layer a23 (see FIG. 4).

According to the constitution Y, the interlayer peeling is less likely to occur even when the full length bias layer is the low RC layer. The constitution Y facilitates the end sticking even when the full length bias layer is the low RC layer.

In the shaft 6, the full length bias layer a23 is located on the innermost side among the full length layers. In this case, the end sticking of the united sheet a23 to the mandrel can be easily performed by using the tacking resin. Therefore, even when the full length bias layer a23 is the low RC layer, the end sticking is facilitated, to suppress the winding fault.

Since the angle θa of the full length bias layer a23 is not 0 degree, unwinding is apt to be produced. The unwinding is a phenomenon in which the once wound sheet rises and the winding is unraveled. The unwinding is produced by characteristics of a fiber willing to straighten.

In respects of the easiness of the end sticking and of the suppression of the unwinding, a bias sheet a23 is preferably wound in a state where the bias sheet a23 is heated. Specifically, a temperature T1 of the bias sheet a23 in winding is preferably equal to or greater than 30° C., and more preferably equal to or greater than 35° C. When the heating temperature is too high, the curing of the matrix resin may be progressed, to reduce the tackiness of the sheet. In this respect, the temperature T1 is preferably equal to or less than 60° C., more preferably equal to or less than 50° C., and still more preferably equal to or less than 40° C.

In the shaft 6, all the full length bias layers a2 and a3 are the low RC layers. Therefore, the ply number of the low RC layer is high. The shaft 6 having a lighter weight is realized by using the low RC layer as the full length bias layer.

In the shaft 6, a resin content of at least one layer of the full length straight layers is lower than a resin content of the full length bias layer. Specifically, a resin content of the full length straight layer a5 is lower than a resin content of the full length bias layer. Similarly, a resin content of the full length straight layer a7 is lower than a resin content of the full length bias layer. The straight sheet can be easily wound as compared with the bias sheet. The straight sheet is flexible to a winding direction because the angle θa is equal to or less than 10 degrees, and the unwinding is less likely to occur. Therefore, the straight layer tends to be wound even when the resin content is low. The straight layer having a resin content lower than that of the bias layer contributes to the realization of the shaft having a lighter weight and excellent winding accuracy. In this respect, the resin contents of the full length straight layers other than the outermost layer are more preferably lower than a resin content of the full length bias layer.

In the shaft 6, the outermost full length layer is the high RC layer. As described above, the outer surface of the shaft is usually polished. Polishing error is suppressed by using the high RC full length layer as the outermost layer. The fine split of the fiber caused by polishing is suppressed.

In respect of weight saving, the ratio of the low RC layer is preferably set to be equal to or greater than 50% by mass based on the mass of the shaft. More preferably, the ratio of the low RC layer is equal to or greater than 55% by mass based on the mass of the shaft, still more preferably equal to or greater than 60% by mass, and yet still more preferably equal to or greater than 65% by mass. In respect of the strength, the ratio of the low RC layer is preferably equal to or less than 80% by mass based on the mass of the shaft, and more preferably equal to or less than 75% by mass.

A shaft having excellent strength, productivity, and winding accuracy can be obtained by the present invention even when the mass of the shaft is lightweight. In this respect, the mass of the shaft is preferably equal to or less than 45 g, and more preferably equal to or less than 40 g.

In respect of the tacking property, the resin content of the full length bias layer is preferably equal to or greater than 16% by mass, and more preferably equal to or greater than 18% by mass. In respect of the weight saving of the shaft, the resin content of the full length bias layer is preferably equal to or less than 25% by mass, and more preferably equal to or less than 20% by mass.

In respect of the tacking property, the resin content of the full length straight layer is preferably equal to or greater than 12% by mass. In respect of the weight saving of the shaft, the resin contents of the full length straight layers other than the outermost layer are preferably equal to or less than 25% by mass, and more preferably equal to or less than 20% by mass.

A difference between resin contents of the mutually abutting low RC full length layer and high RC full length layer is defined as D1. In respect of suppressing the interlayer peeling, to enhance the strength, the difference D1 is preferably equal to or greater than 15% by mass, and more preferably equal to or greater than 18% by mass. When the resin content of a prepreg material capable of being obtained is considered, the difference D1 is preferably equal to or less than 30% by mass, and more preferably equal to or less than 25% by mass.

In the high-low united sheet, a difference D2 between resin contents of the low RC sheet and high RC sheet is preferably equal to or greater than 15% by mass, and more preferably equal to or greater than 18% by mass. The deviation between the low RC sheet and the high RC sheet during winding is suppressed by increasing the difference D2, to improve the winding accuracy. Furthermore, the interlayer strength between the low RC layer and the high RC layer is improved. When the resin content of the prepreg material capable of being obtained is considered, the difference D2 is preferably equal to or less than 30% by mass, and more preferably equal to or less than 25% by mass.

In the production (lamination) of the high-low united sheet, the high-low united sheet is preferably heated. The deviation between the low RC sheet and the high RC sheet during winding is suppressed by the heating, to improve the winding accuracy. Furthermore, the interlayer strength between the low RC layer and the high RC layer is improved. In these respects, the heating temperature in the laminating process of the high-low united sheet is preferably equal to or greater than 30° C., and more preferably equal to or greater than 35° C. When the heating temperature is too high, the curing of the matrix resin may be progressed, to reduce the tackiness of the sheet. The reduction of the tackiness reduces the adhesion between the high-low united sheet and the wound object. In this respect, the heating temperature in the laminating process of the high-low united sheet is preferably equal to or less than 60° C., more preferably equal to or less than 50° C., and still more preferably equal to or less than 40° C.

As shown in the embodiment, in an example of a preferred aspect, at least one of the full length straight layers is the low RC layer. All the full length bias layers are preferably the low RC layers. All the full length hoop layers are preferably the high RC layers. All low RC full length straight sheets are preferably wound after being laminated on the high RC sheet. More preferably, all the low RC full length straight sheets are wound after being laminated on the high RC hoop sheet. An end sticking high-low united sheet is preferably wound with the low RC sheet side set to the inside.

In respect of the easiness of the winding, the high RC sheet in the high-low united sheet is preferably thin. In this respect, the thickness of the high RC sheet in the high-low united sheet is preferably equal to or less than 0.05 mm, and more preferably equal to or less than 0.04 mm. In respect of the easiness of the winding, the CF weight basis of the high RC sheet in the high-low united sheet is preferably small. In this respect, the CF weight basis of the high RC sheet in the high-low united sheet is preferably equal to or less than 40 g/m$^2$, and more preferably equal to or less than 30 g/m$^2$. The CF weight basis is a fiber mass per 1 m$^2$ of the prepreg.

In addition to an epoxy resin, a thermosetting resin other than the epoxy resin and a thermoplastic resin or the like may be used as the matrix resin of the prepreg sheet. In respect of the shaft strength, the matrix resin is preferably the epoxy resin.

EXAMPLES

Hereinafter, the effects of the present invention will be clarified by examples. However, the present invention should not be interpreted in a limited way based on the description of the examples.

Example 1

A shaft having the same laminated constitution as that of the shaft 6 was produced. That is, a shaft which having a sheet constitution shown in FIGS. 2 and 3 was produced. A manufacturing method is the same as that of the shaft 6. Varieties of prepregs used for sheets are shown in the following Table 1.

Example 2

Figure 5:
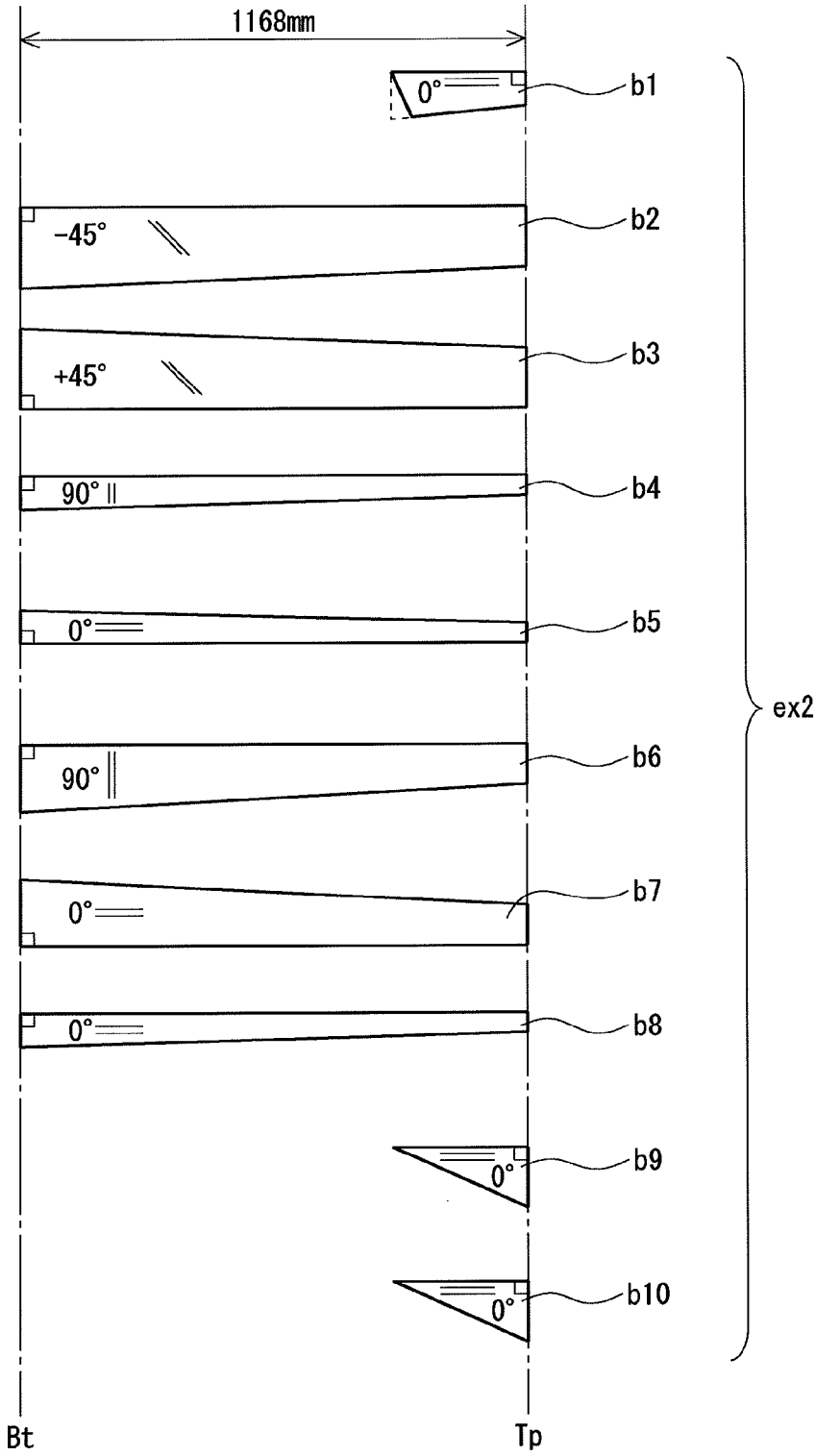
FIG. 5 is a developed view of example 2.

A shaft having a sheet constitution shown in FIG. 5 was produced. A full length bias sheet b2 and a full length bias sheet b3 were laminated, to produce an united sheet b23 (not shown), and the united sheet b23 was wound. A full length hoop sheet b4 and a full length straight sheet b5 were laminated, to produce an SF united sheet b45 (not shown), and the united sheet b45 was wound. A full length hoop sheet b6 and a full length straight sheet b7 were laminated, to produce an SF united sheet b67 (not shown), and the united sheet b67 was wound. Varieties of prepregs used for the sheets are shown in the following Table 2.

Example 2 is different from example 1 in resin contents of a fourth and sixth sheets. As shown in Table 2, trial products having a resin content of 25% by mass were used as the full length hoop sheet b4 and the full length hoop sheet b6. A shaft of example 2 was obtained in the same manner as in example 1 except for above.

Example 3

Figure 6:
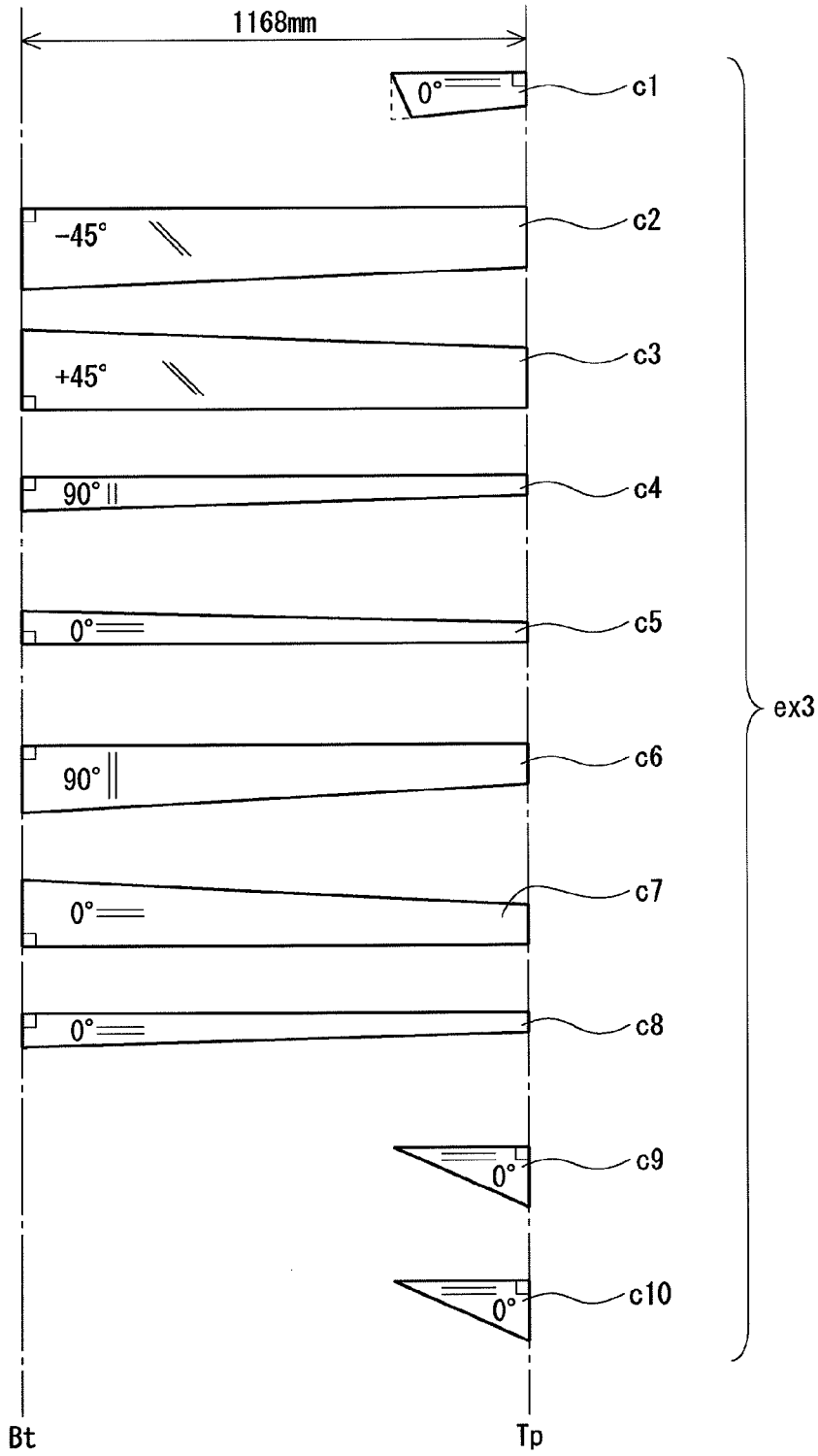
FIG. 6 is a developed view of example 3.

A shaft having a sheet constitution shown in FIG. 6 was produced. A full length bias sheet c2 and a full length bias sheet c3 were laminated, to produce an united sheet c23 (not shown), and the united sheet c23 was wound. A full length hoop sheet c4 and a full length straight sheet c5 were laminated, to produce an SF united sheet c45 (not shown), and the united sheet c45 was wound. A full length hoop sheet c6 and a full length straight sheet c7 were laminated, to produce an SF united sheet c67 (not shown), and the united sheet c67 was wound. Varieties of prepregs used for the sheets are shown in the following Table 3.

Example 3 is different from example 1 in the resin content of the bias sheet. As shown in Table 3, prepregs having a resin content of 25% by mass were used as the full length bias sheet c2 and the full length bias sheet c3. A shaft of example 3 was obtained in the same manner as in example 1 except for above.

Comparative Example 1

Figure 7:
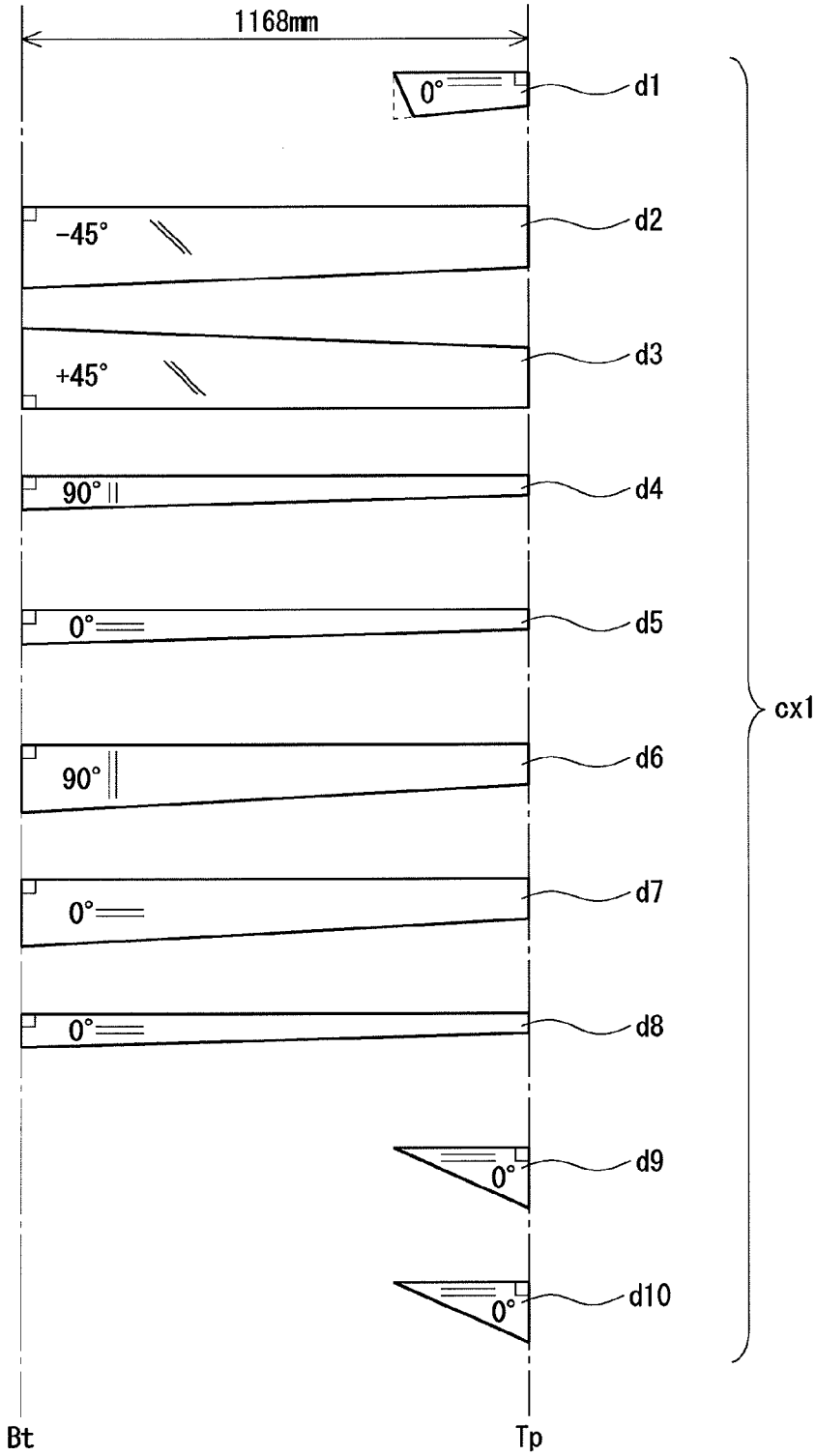
FIG. 7 is a developed view of comparative example 1.

A shaft having a sheet constitution shown in FIG. 7 was produced. A full length bias sheet d2 and a full length bias sheet d3 were laminated, to produce an united sheet d23 (not shown), and the united sheet d23 was wound. The other sheets were not laminated. Varieties of prepregs used for the sheets are shown in the following Table 4.

Comparative example 1 is different from example 1 in the existence or nonexistence of the lamination. That is, in comparative example 1, sheets other than the bias sheet were not laminated. As a result, a low RC sheet d7 having winding number of 2 plies causes overlapping of two low RC layers d7. A shaft of comparative example 1 was obtained in the same manner as in example 1 except for above.

Comparative Example 2

Figure 8:
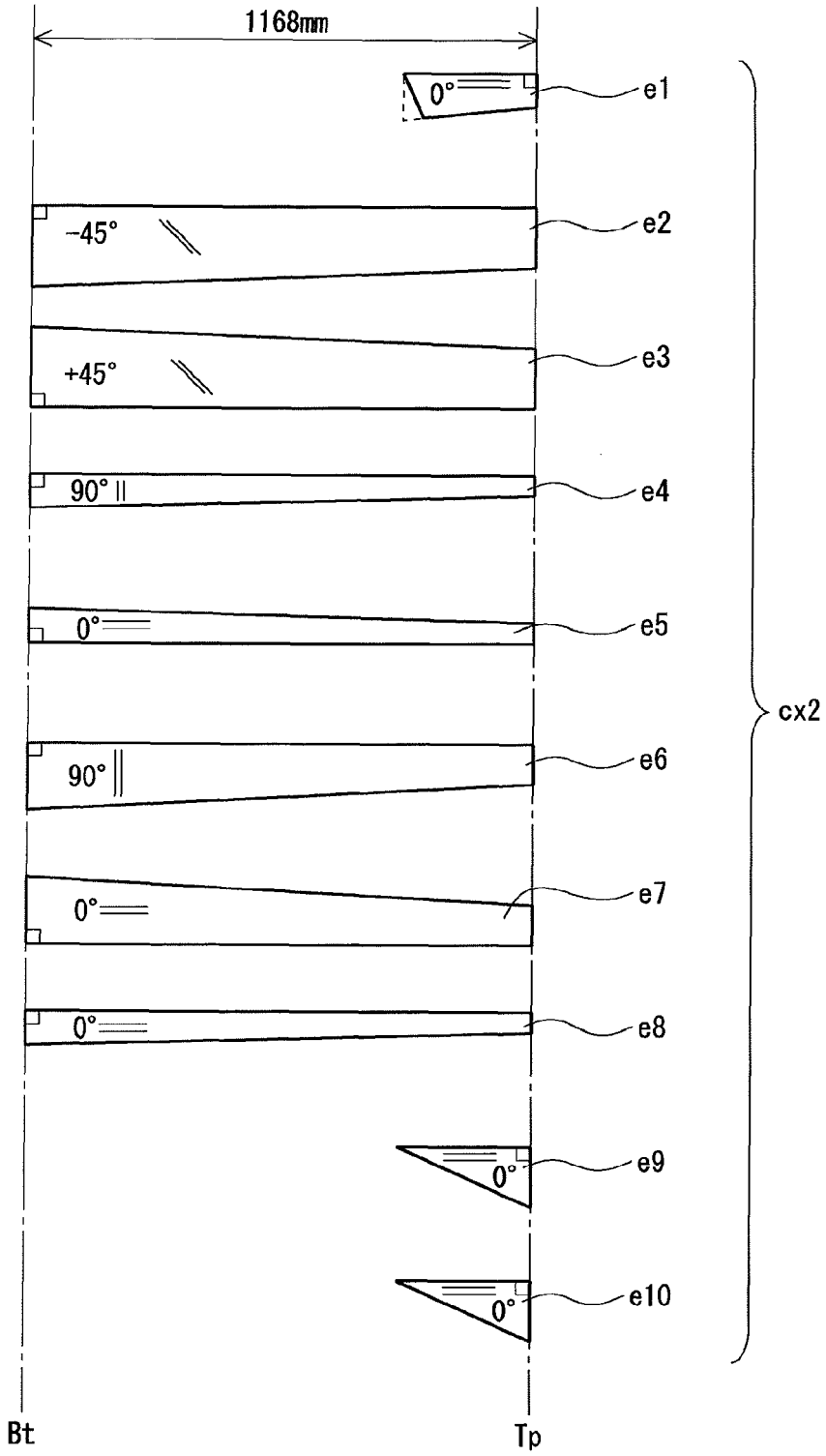
FIG. 8 is a developed view of comparative example 2.

A shaft having a sheet constitution shown in FIG. 8 was produced. A full length bias sheet e2 and a full length bias sheet e3 were laminated, to produce an united sheet e23 (not shown), and the united sheet e23 was wound. A full length hoop sheet e4 and a full length straight sheet e5 were laminated, to produce an SF united sheet e45 (not shown), and the united sheet e45 was wound. A full length hoop sheet e6 and a full length straight sheet e7 were laminated, to produce an SF united sheet e67 (not shown), and the united sheet e67 was wound. Varieties of prepregs used for the sheets are shown in the following Table 5.

Comparative example 2 is different from example 1 in nonuse of the low RC sheet. A shaft of comparative example 2 was obtained in the same manner as in example 1 except for above.

Comparative Example 3

Figure 9:
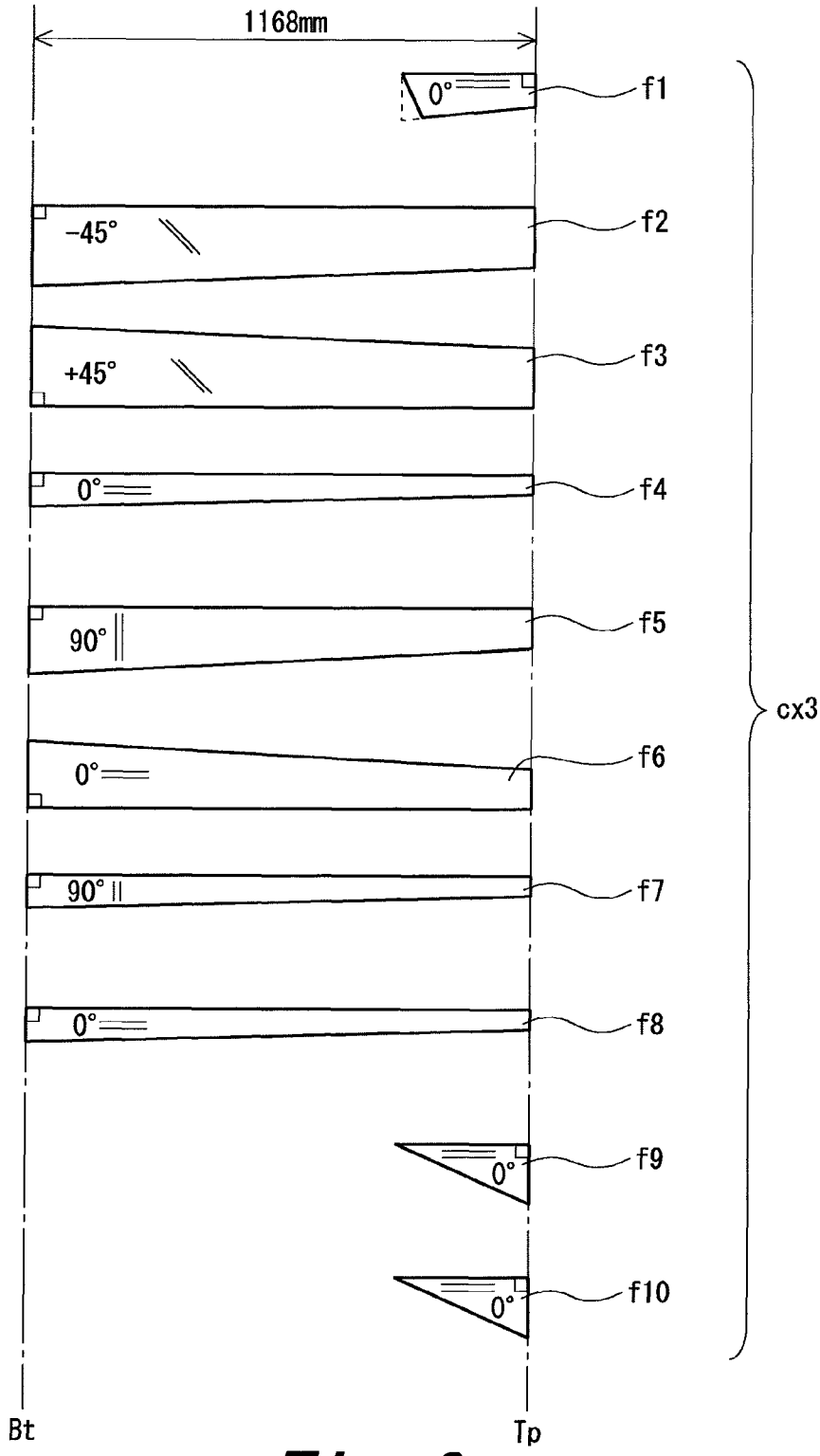
FIG. 9 is a developed view of comparative example 3.

A shaft having a sheet constitution shown in FIG. 9 was produced. A full length bias sheet f2 and a full length bias sheet f3 were laminated, to produce an united sheet f23 (not shown), and the united sheet f23 was wound. A full length hoop sheet f5 and a full length straight sheet f6 were laminated, to produce an SF united sheet f56 (not shown), and the united sheet f56 was wound. The other sheets were wound without being laminated. Varieties of prepregs used for the sheets are shown in the following Table 6.

Comparative example 3 is different from example 1 in a lamination order. A fourth sheet (sheet a4) in example 1 is a seventh sheet (sheet f7) in comparative example 3. As a result, a low RC layer f4 is brought into contact with an outer surface of a bias layer f23. On the other hand, in example 1, the high RC layer a4 is brought into contact with the outer surface of the bias layer, and the low RC layer a5 is brought into contact with the outside of the high RC layer a4. A shaft of comparative example 3 was obtained in the same manner as in example 1 except for above.

Comparative Example 4

Figure 10:
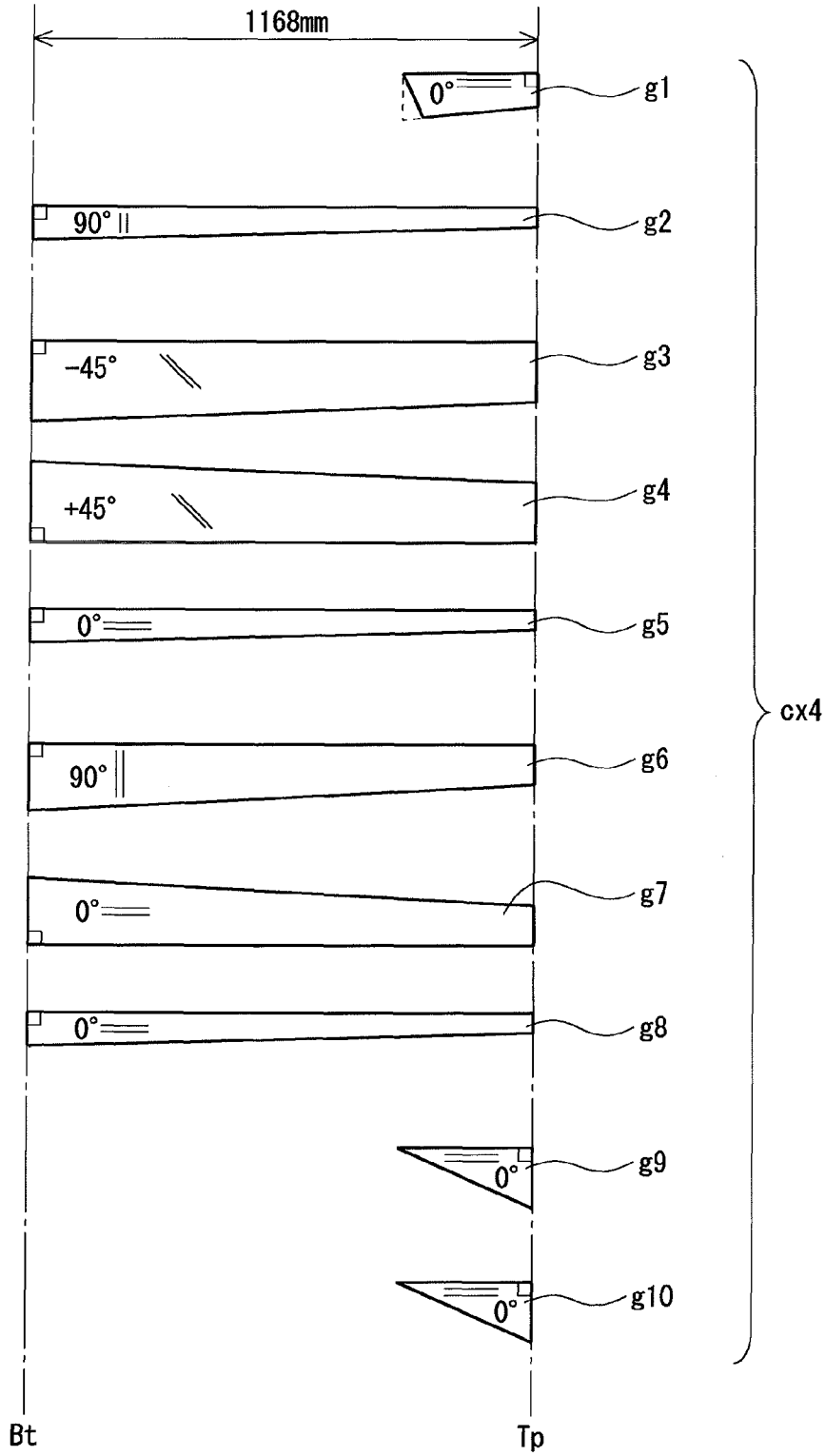
FIG. 10 is a developed view of comparative example 4.

A shaft having a sheet constitution shown in FIG. 10 was produced. A full length bias sheet g3 and a full length bias sheet g4 were laminated, to produce an united sheet g34 (not shown), and the united sheet g34 was wound. A full length hoop sheet g6 and a full length straight sheet g7 were laminated, to produce an SF united sheet g67 (not shown), and the united sheet g67 was wound. The other sheets were wound without being laminated. Varieties of prepregs used for the sheets are shown in the following Table 7.

Comparative example 4 is different from example 1 in a lamination order. A fourth sheet (sheet a4) in example 1 is a second sheet (sheet g2) in comparative example 4. As a result, a full length bias layer g34 is not located on the innermost side among the full length layers. As a result, the low RC full length layer g7 and the low RC full length layer g8 are brought into contact with each other. A shaft of comparative example 4 was obtained in the same manner as in example 1 except for above.

Comparative Example 5

Figure 11:
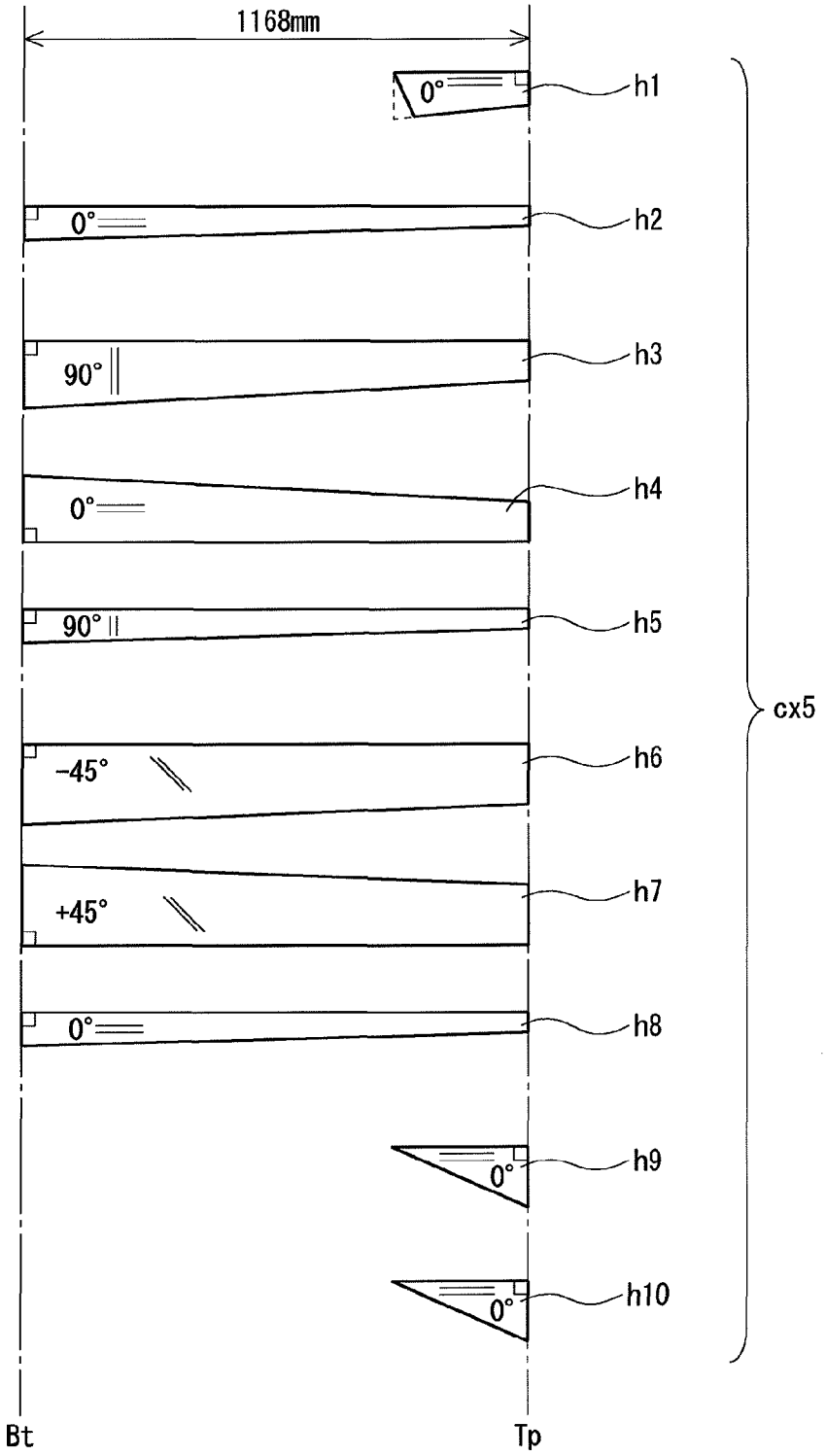
FIG. 11 is a developed view of comparative example 5.

A shaft having a sheet constitution shown in FIG. 11 was produced. A full length bias sheet h6 and a full length bias sheet h7 were laminated, to produce an united sheet h67 (not shown), and the united sheet h67 was wound. A full length hoop sheet h3 and a full length straight sheet h4 were laminated, to produce an SF united sheet h34 (not shown), and the united sheet h34 was wound. The other sheets were wound without being laminated. Varieties of prepregs used for the sheets are shown in the following Table 8.

Comparative example 5 is different from example 1 in a lamination order. In comparative example 5, a bias layer h67 is located outside. A shaft of comparative example 5 was obtained in the same manner as in example 1 except for above.

Comparative Example 6

Figure 12:
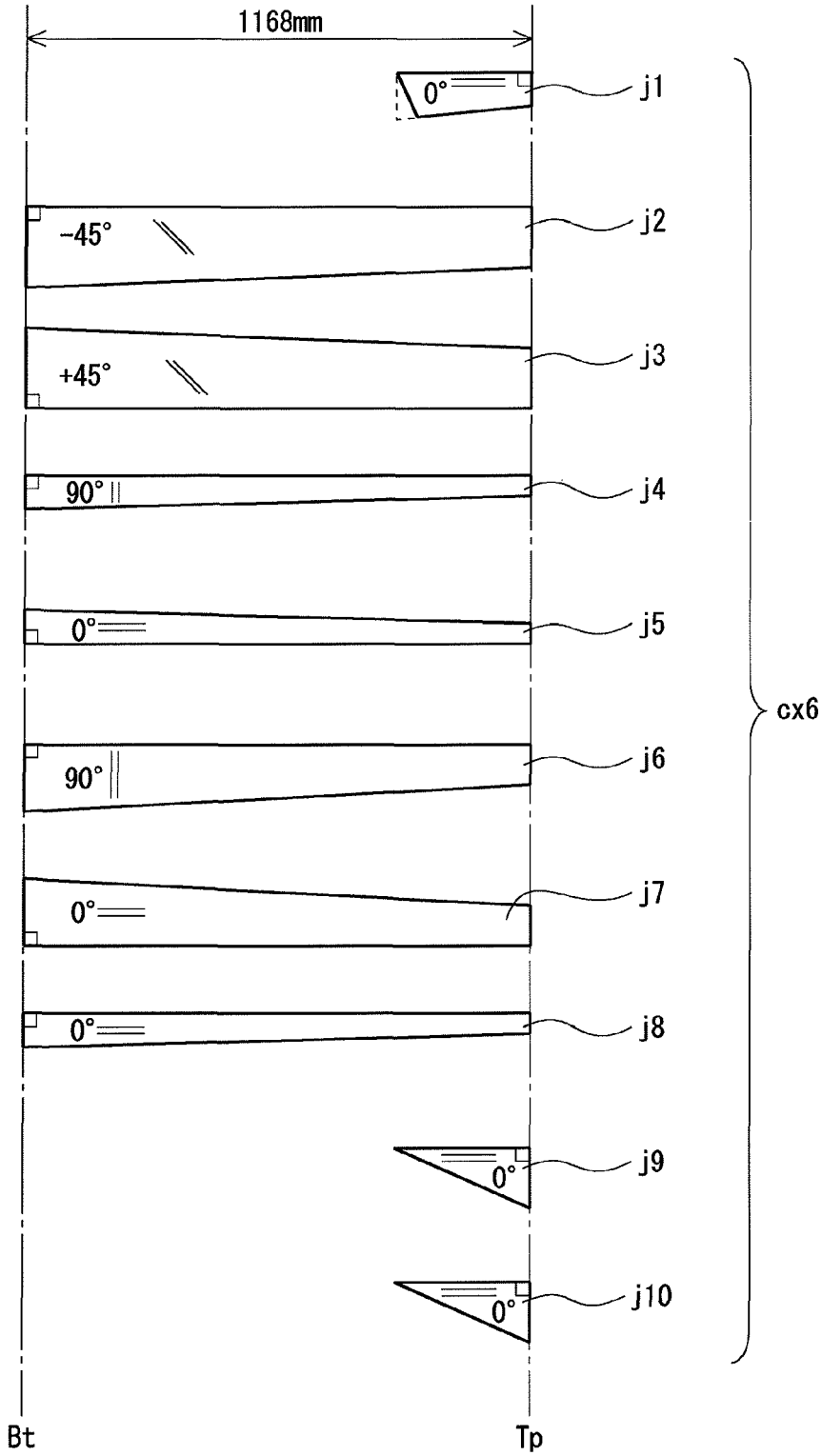
FIG. 12 is a developed view of comparative example 6.

A shaft having a sheet constitution shown in FIG. 12 was produced. A full length bias sheet j2 and a full length bias sheet j3 were laminated, to produce an united sheet j23 (not shown), and the united sheet j23 was wound. A full length hoop sheet j4 and a full length straight sheet j5 were laminated, to produce an SF united sheet j45 (not shown), and the united sheet j45 was wound. A full length hoop sheet j6 and a full length straight sheet j7 were laminated, to produce an SF united sheet j67 (not shown), and the united sheet j67 was wound. The other sheets were wound without being laminated. Varieties of prepregs used for the sheets are shown in the following Table 9.

Comparative example 6 is different from example 1 in the variety of the prepreg. A low RC sheet is not used in comparative example 6. A shaft of comparative example 6 was obtained in the same manner as in example 1 except for above.

Evaluation results of these shafts are shown in the following Table 10.

TABLE 1

Laminated constitution of example 1

| Sheet (layer) | Variety of prepreg | Orientation angle Af of fiber (°) | CF weight basis (g/m$^2$) | Resin content (wt %) | Elastic modulus of fiber (ton/mm$^2$) | Prepreg mass (g) | Classification | Winding number |
|---|---|---|---|---|---|---|---|---|
| a1 | TR350C-100S | 0° | 100 | 25 | 24 | 1.1 | Partial layer | — |
| a2 | Trial product RC18% | −45° | 75 | 18 | 40 | 5.7 | Full length layer | — |
| a3 | Trial product RC18% | +45° | 75 | 18 | 40 | 5.7 | Full length layer | — |

TABLE 1-continued

Laminated constitution of example 1

| Sheet (layer) | Variety of prepreg | Orientation angle Af of fiber (°) | CF weight basis (g/m$^2$) | Resin content (wt %) | Elastic modulus of fiber (ton/mm$^2$) | Prepreg mass (g) | Classification | Winding number |
|---|---|---|---|---|---|---|---|---|
| a4 | 805S-3 | 90° | 30 | 40 | 30 | 1.4 | Full length layer | 1 |
| a5 | Trial product RC15% | 0° | 100 | 15 | 24 | 4.6 | Full length layer | 1 |
| a6 | 805S-3 | 90° | 30 | 40 | 30 | 3.2 | Full length layer | 2 |
| a7 | Trial product RC15% | 0° | 100 | 15 | 24 | 10.2 | Full length layer | 2 |
| a8 | MR350C-100S | 0° | 100 | 25 | 30 | 5.7 | Full length layer | 1 |
| a9 | TR350C-100S | 0° | 100 | 25 | 24 | 1.4 | Partial layer | — |
| a10 | TR350C-100S | 0° | 100 | 25 | 24 | 1.4 | Partial layer | — |

TABLE 2

Laminated constitution of example 2

| Sheet (layer) | Variety of prepreg | Orientation angle Af of fiber (°) | CF weight basis (g/m$^2$) | Resin content (wt %) | Elastic modulus of fiber (ton/mm$^2$) | Prepreg mass (g) | Classification | Winding number |
|---|---|---|---|---|---|---|---|---|
| b1 | TR350C-100S | 0° | 100 | 25 | 24 | 1.1 | Partial layer | — |
| b2 | Trial product RC18% | −45° | 75 | 18 | 40 | 5.7 | Full length layer | — |
| b3 | Trial product RC18% | +45° | 75 | 18 | 40 | 5.7 | Full length layer | — |
| b4 | Trial product RC25% | 90° | 30 | 25 | 30 | 1 | Full length layer | 1 |
| b5 | Trial product RC15% | 0° | 100 | 15 | 24 | 4.6 | Full length layer | 1 |
| b6 | Trial product RC25% | 90° | 30 | 25 | 30 | 2.4 | Full length layer | 2 |
| b7 | Trial product RC15% | 0° | 100 | 15 | 24 | 10.2 | Full length layer | 2 |
| b8 | MR350C-100S | 0° | 100 | 25 | 30 | 5.7 | Full length layer | 1 |
| b9 | TR350C-100S | 0° | 100 | 25 | 24 | 1.4 | Partial layer | — |
| b10 | TR350C-100S | 0° | 100 | 25 | 24 | 1.4 | Partial layer | — |

TABLE 3

Laminated constitution of example 3

| Sheet (layer) | Variety of prepreg | Orientation angle Af of fiber (°) | CF weight basis (g/m$^2$) | Resin content (wt %) | Elastic modulus of fiber (ton/mm$^2$) | Prepreg mass (g) | Classification | Winding number |
|---|---|---|---|---|---|---|---|---|
| c1 | TR350C-100S | 0° | 100 | 25 | 24 | 1.1 | Partial layer | — |
| c2 | MR350C-075S | −45° | 75 | 25 | 40 | 6.6 | Full length layer | — |
| c3 | MR350C-075S | +45° | 75 | 25 | 40 | 6.6 | Full length layer | — |
| c4 | 805S-3 | 90° | 30 | 40 | 30 | 1.4 | Full length layer | 1 |
| c5 | Trial product RC15% | 0° | 100 | 15 | 24 | 4.6 | Full length layer | 1 |
| c6 | 805S-3 | 90° | 30 | 40 | 30 | 3.2 | Full length layer | 2 |
| c7 | Trial product RC15% | 0° | 100 | 15 | 24 | 10.2 | Full length layer | 2 |
| c8 | MR350C-100S | 0° | 100 | 25 | 30 | 5.7 | Full length layer | 1 |
| c9 | TR350C-100S | 0° | 100 | 25 | 24 | 1.4 | Partial layer | — |
| c10 | TR350C-100S | 0° | 100 | 25 | 24 | 1.4 | Partial layer | — |

TABLE 4

Laminated constitution of comparative example 1

| Sheet (layer) | Variety of prepreg | Orientation angle Af of fiber (°) | CF weight basis (g/m$^2$) | Resin content (wt %) | Elastic modulus of fiber (ton/mm$^2$) | Prepreg mass (g) | Classification | Winding number |
|---|---|---|---|---|---|---|---|---|
| d1 | TR350C-100S | 0° | 100 | 25 | 24 | 1.1 | Partial layer | — |
| d2 | Trial product RC18% | −45° | 75 | 18 | 40 | 5.7 | Full length layer | — |
| d3 | Trial product RC18% | +45° | 75 | 18 | 40 | 5.7 | Full length layer | — |
| d4 | 805S-3 | 90° | 30 | 40 | 30 | 1.4 | Full length layer | 1 |
| d5 | Trial product RC15% | 0° | 100 | 15 | 24 | 4.6 | Full length layer | 1 |
| d6 | 805S-3 | 90° | 30 | 40 | 30 | 3.2 | Full length layer | 2 |
| d7 | Trial product RC15% | 0° | 100 | 15 | 24 | 10.2 | Full length layer | 2 |
| d8 | MR350C-100S | 0° | 100 | 25 | 30 | 5.7 | Full length layer | 1 |
| d9 | TR350C-100S | 0° | 100 | 25 | 24 | 1.4 | Partial layer | — |
| d10 | TR350C-100S | 0° | 100 | 25 | 24 | 1.4 | Partial layer | — |

TABLE 5

Laminated constitution of comparative example 2

| Sheet (layer) | Variety of prepreg | Orientation angle Af of fiber (°) | CF weight basis (g/m$^2$) | Resin content (wt %) | Elastic modulus of fiber (ton/mm$^2$) | Prepreg mass (g) | Classification | Winding number |
|---|---|---|---|---|---|---|---|---|
| e1 | TR350C-100S | 0° | 100 | 25 | 24 | 1.1 | Partial layer | — |
| e2 | HRX350C-075S | −45° | 75 | 25 | 40 | 6.6 | Full length layer | — |
| e3 | HRX350C-075S | +45° | 75 | 25 | 40 | 6.6 | Full length layer | — |
| e4 | 805S-3 | 90° | 30 | 40 | 30 | 1.4 | Full length layer | 1 |
| e5 | TR350C-100S | 0° | 100 | 25 | 24 | 5.1 | Full length layer | 1 |
| e6 | 805S-3 | 90° | 30 | 40 | 30 | 3.2 | Full length layer | 2 |
| e7 | TR350C-100S | 0° | 100 | 25 | 24 | 11.3 | Full length layer | 2 |
| e8 | MR350C-100S | 0° | 100 | 25 | 30 | 5.7 | Full length layer | 1 |
| e9 | TR350C-100S | 0° | 100 | 25 | 24 | 1.4 | Partial layer | — |
| e10 | TR350C-100S | 0° | 100 | 25 | 24 | 1.4 | Partial layer | — |

TABLE 6

Laminated constitution of comparative example 3

| Sheet (layer) | Variety of prepreg | Orientation angle Af of fiber (°) | CF weight basis (g/m$^2$) | Resin content (wt %) | Elastic modulus of fiber (ton/mm$^2$) | Prepreg mass (g) | Classification | Winding number |
|---|---|---|---|---|---|---|---|---|
| f1 | TR350C-100S | 0° | 100 | 25 | 24 | 1.1 | Partial layer | — |
| f2 | Trial product RC18% | −45° | 75 | 18 | 40 | 5.7 | Full length layer | — |
| f3 | Trial product RC18% | +45° | 75 | 18 | 40 | 5.7 | Full length layer | — |
| f4 | Trial product RC15% | 0° | 100 | 15 | 24 | 4.6 | Full length layer | 1 |
| f5 | 805S-3 | 90° | 30 | 40 | 30 | 3.2 | Full length layer | 2 |
| f6 | Trial product RC15% | 0° | 100 | 15 | 24 | 10.2 | Full length layer | 2 |
| f7 | 805S-3 | 90° | 30 | 40 | 30 | 1.4 | Full length layer | 1 |
| f8 | MR350C-100S | 0° | 100 | 25 | 30 | 5.7 | Full length layer | 1 |
| f9 | TR350C-100S | 0° | 100 | 25 | 24 | 1.4 | Partial layer | — |
| f10 | TR350C-100S | 0° | 100 | 25 | 24 | 1.4 | Partial layer | — |

TABLE 7

Laminated constitution of comparative example 4

| Sheet (layer) | Variety of prepreg | Orientation angle Af of fiber (°) | CF weight basis (g/m$^2$) | Resin content (wt %) | Elastic modulus of fiber (ton/mm$^2$) | Prepreg mass (g) | Classification | Winding number |
|---|---|---|---|---|---|---|---|---|
| g1 | TR350C-100S | 0° | 100 | 25 | 24 | 1.1 | Partial layer | — |
| g2 | 805S-3 | 90° | 30 | 40 | 30 | 1.4 | Full length layer | 1 |
| g3 | Trial product RC18% | −45° | 75 | 18 | 40 | 5.7 | Full length layer | — |
| g4 | Trial product RC18% | +45° | 75 | 18 | 40 | 5.7 | Full length layer | — |
| g5 | Trial product RC15% | 0° | 100 | 15 | 24 | 4.6 | Full length layer | 1 |
| g6 | 805S-3 | 90° | 30 | 40 | 30 | 3.2 | Full length layer | 2 |
| g7 | Trial product RC15% | 0° | 100 | 15 | 24 | 10.2 | Full length layer | 2 |
| g8 | Trial product RC15% | 0° | 125 | 15 | 24 | 6.3 | Full length layer | 1 |
| g9 | TR350C-100S | 0° | 100 | 25 | 24 | 1.4 | Partial layer | — |
| g10 | TR350C-100S | 0° | 100 | 25 | 24 | 1.4 | Partial layer | — |

TABLE 8

Laminated constitution of comparative example 5

| Sheet (layer) | Variety of prepreg | Orientation angle Af of fiber (°) | CF weight basis (g/m$^2$) | Resin content (wt %) | Elastic modulus of fiber (ton/mm$^2$) | Prepreg mass (g) | Classification | Winding number |
|---|---|---|---|---|---|---|---|---|
| h1 | TR350C-100S | 0° | 100 | 25 | 24 | 1.1 | Partial layer | — |
| h2 | Trial product RC15% | 0° | 100 | 15 | 24 | 4.6 | Full length layer | 1 |
| h3 | 805S-3 | 90° | 30 | 40 | 30 | 3.2 | Full length layer | 2 |
| h4 | Trial product RC15% | 0° | 100 | 15 | 24 | 10.2 | Full length layer | 2 |
| h5 | 805S-3 | 90° | 30 | 40 | 30 | 1.4 | Full length layer | 1 |
| h6 | Trial product RC18% | −45° | 75 | 18 | 40 | 5.7 | Full length layer | — |

TABLE 8-continued

Laminated constitution of comparative example 5

| Sheet (layer) | Variety of prepreg | Orientation angle Af of fiber (°) | CF weight basis (g/m$^2$) | Resin content (wt %) | Elastic modulus of fiber (ton/mm$^2$) | Prepreg mass (g) | Classification | Winding number |
|---|---|---|---|---|---|---|---|---|
| h7 | Trial product RC18% | +45° | 75 | 18 | 40 | 5.7 | Full length layer | — |
| h8 | MR350C-100S | 0° | 100 | 25 | 30 | 5.7 | Full length layer | 1 |
| h9 | TR350C-100S | 0° | 100 | 25 | 24 | 1.4 | Partial layer | — |
| h10 | TR350C-100S | 0° | 100 | 25 | 24 | 1.4 | Partial layer | — |

TABLE 9

Laminated constitution of comparative example 6

| Sheet (layer) | Variety of prepreg | Orientation angle Af of fiber (°) | CF weight basis (g/m$^2$) | Resin content (wt %) | Elastic modulus of fiber (ton/mm$^2$) | Prepreg mass (g) | Classification | Winding number |
|---|---|---|---|---|---|---|---|---|
| j1 | TR350C-100S | 0° | 100 | 25 | 24 | 1.1 | Partial layer | — |
| j2 | MR350C-100S | −45° | 100 | 25 | 30 | 8.6 | Full length layer | — |
| j3 | MR350C-100S | +45° | 100 | 25 | 30 | 8.6 | Full length layer | — |
| j4 | 805S-3 | 90° | 30 | 40 | 30 | 1.4 | Full length layer | 1 |
| j5 | TR350C-100S | 0° | 100 | 25 | 24 | 5.1 | Full length layer | 1 |
| j6 | 805S-3 | 90° | 30 | 40 | 30 | 3.2 | Full length layer | 2 |
| j7 | TR350C-100S | 0° | 100 | 25 | 24 | 11.3 | Full length layer | 2 |
| j8 | MR350C-100S | 0° | 100 | 25 | 30 | 5.7 | Full length layer | 1 |
| j9 | TR350C-100S | 0° | 100 | 25 | 24 | 1.4 | Partial layer | — |
| j10 | TR350C-100S | 0° | 100 | 25 | 24 | 1.4 | Partial layer | — |

TABLE 10

Evaluation results of examples and comparative examples

| | Shaft | Mass before | Ratio of low RC | Mass after | Forward | | Three-point bending strength | | | | Durability | Easiness of swing in real hitting |
|---|---|---|---|---|---|---|---|---|---|---|---|---|
| | length mm | polishing g | layer % by mass | polishing g | flex mm | Torque deg | T point kgf | A point kgf | B point kgf | C point kgf | test times | scale of one to five |
| Example 1 | 1168 | 40.4 | 64.9 | 39 | 170 | 6.5 | 200 | 76 | 70 | 93 | 10000 | 4.3 |
| Example 2 | 1168 | 39.2 | 66.8 | 38 | 170 | 6.5 | 181 | 62 | 58 | 75 | 5600 | 4.5 |
| Example 3 | 1168 | 42.2 | 35.1 | 41 | 170 | 6.5 | 204 | 75 | 70 | 94 | 10000 | 3.1 |
| Comparative example 1 | 1168 | 40.4 | 64.9 | 39 | 170 | 6.5 | 192 | 72 | 65 | 86 | 10000 | 4.2 |
| Comparative example 2 | 1168 | 43.8 | 0 | 42 | 170 | 6.5 | 208 | 80 | 79 | 100 | 10000 | 3.1 |
| Comparative example 3 | 1168 | 40.4 | 64.9 | 39 | 170 | 6.5 | 171 | 61 | 61 | 79 | 8000 | 4.2 |
| Comparative example 4 | 1168 | 41.0 | 79.3 | 39 | 170 | 6.5 | 166 | 52 | 53 | 66 | 4800 | 4.2 |
| Comparative example 5 | 1168 | 40.4 | 64.9 | 39 | 180 | 6.2 | 187 | 68 | 60 | 79 | 8000 | 3.7 |
| Comparative example 6 | 1168 | 47.8 | 0 | 46 | 170 | 6.5 | 242 | 100 | 97 | 120 | 10000 | 2.5 |

[Evaluation Methods]

[Three-Point Bending Strength]

An SG type three-point bending strength test was employed. This is a test set by the Consumer Product Safety Association.

Figure 13:
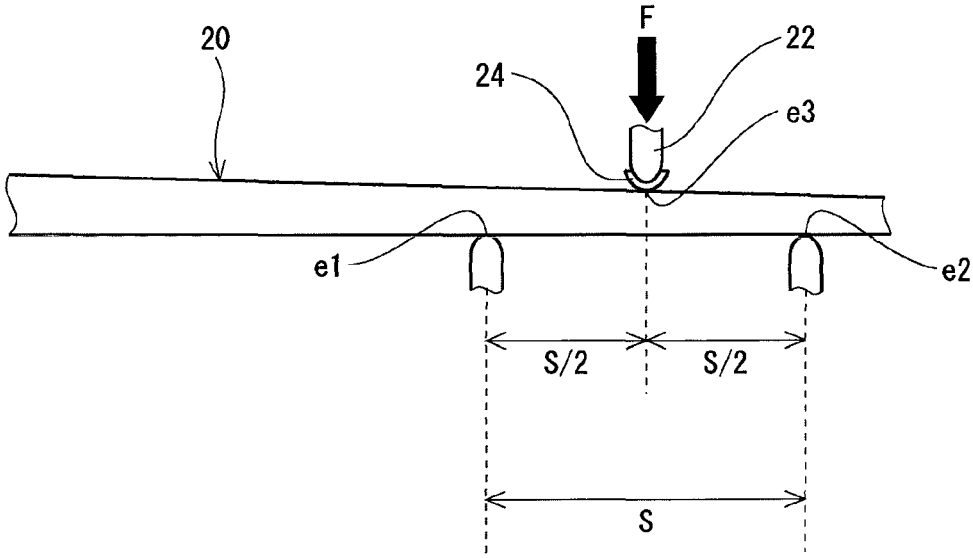
FIG. 13 illustrates a method for measuring a three-point bending strength.

FIG. 13 shows a measuring method of the SG type three-point bending strength test. As shown in FIG. 13, an indenter 22 applies a load F downward from above at a load point e3 while a shaft 20 is supported from below at two supporting points e1 and e2. The load point e3 is placed at a position bisecting the supporting points e1 and e2. A descent speed of the indenter 22 is 20 mm/min. Silicone rubber 24 is mounted to a tip of the indenter 22. The load point e3 is a measuring point. The measuring points were set to a point T, a point A, a point B, and a point C. The point T is placed apart from a tip Tp by 90 mm. The point A is placed apart from the tip Tp by 175 mm. The point B is placed apart from the tip Tp by 525 mm. The point C is placed apart from the butt Bt by 175 mm. A value (peak value) of the load F when the shaft 20 was broken was measured. When the point T is measured, the span S is set to 150 mm. When the point A, the point B, and the point C are measured, the span S is set to 300 mm. The results are shown in Table 10.

[Durability Test]

A commercially available driver head and grip were mounted to the obtained shaft, to produce a golf club of 46 inches. The club was mounted to a swing robot, and the swing robot hit balls until the shaft was broken. A head speed was set to 48 m/s. When the shaft was not broken, the test was ended after 10,000 balls were hit. "SHOT ROBO III" (trade name) manufactured by Miyamae Co., Ltd. was used as the swing robot. "XXIO SUPER XD" (trade name) manufactured by SRI Sports Ltd. was used for the ball.

[Easiness of Swing]

Twenty testers hit balls using the club, and evaluated easiness of hit. The testers made five-stage evaluation on a scale of one to five. The higher the score is, the higher the evaluation is. The average of the twenty testers' evaluation scores is shown in Table 10.

[Forward Flex]

A first supporting point was set at a position which is 75 mm away from the butt Bt of the shaft. Furthermore, a second supporting point was set at a position which is 215 mm away from the butt Bt of the shaft. A support supporting the shaft from above was provided at the first supporting point. A support supporting the shaft from beneath was provided at the second supporting point. In a state where no load was applied, the shaft axis line of the shaft was substantially horizontal. At a weight point which was positioned 1039 mm away from the butt Bt, a load of 2.7 kg was allowed to act in a vertical downward direction. A travel distance (mm) of the weight point between the state where no load was applied and the state where a load was applied was determined as the forward flex. The travel distance is a distance of the movement along the vertical direction. The measured values are shown in Table 10.

[Torque]

A butt end part of a shaft was nonrotatably fixed by a butt jig, and a tip part of the shaft was grasped by a tip jig. A torque Tr of 13.9 kgf·cm was allowed to act on a position which is 40 mm away from the tip Tp. A torsion angle (degree) of the shaft at the torque action position was defined as a shaft torque value. A rotating speed of the tip jig when the torque Tr was loaded was set to be equal to or less than 130 degrees/min, and a length in an axial direction between the butt jig and the tip jig was set to 825 mm. When the shaft is deformed by grasping the tip jig or the butt jig, the shaft torque value is measured with a core material or the like put in the shaft. The measured values are shown in Table 10.

Masses of unpolished shafts and masses of polished shafts are shown in Table 10. A ratio (% by mass) of the low RC layer was calculated based on a weight before polishing. These values are shown in Table 10.

The winding number (number of plies) of the full length layer other than the bias layer is described in Tables 1 to 9.

Since the full length layer brought into contact with a low RC full length layer is a high RC layer in example 1, example 1 has high interlayer strength. For this reason, example 1 had good three-point bending strength and durability test. Example 1 was lightweight and had good easiness of hit.

Since the difference (% by mass) between the resin contents of the high RC hoop layer and low RC straight layer was small (10% by mass) in example 2, example 2 had slightly reduced strength. Example 2 had good lightness and easiness of hit.

Since the ratio of the low RC layer was small in example 3, example 3 had slightly poor lightness and easiness of swing. However, good strength was obtained.

In comparative example 1, the overlapping of the two low RC straight layers is caused by the sheet d7 of two plies. For this reason, comparative example 1 had reduced strength.

Since the low RC layer does not exist in comparative example 2, comparative example 2 has insufficient lightness. For this reason, the easiness of swing was reduced.

Since the low RC full length layer was located on the outer surface of the low RC bias layer in comparative example 3, comparative example 3 had reduced interlayer strength. For this reason, the strength evaluation was poor.

In comparative example 4, the full length low RC layer g5 is brought into contact with the outer surface of the full length low RC bias layer g34, and the full length low RC layer g8 is brought into contact with the full length low RC layer g7. For this reason, the strength evaluation was poor.

In comparative example 5, the bias layer was located outside, and the straight layer was disposed inside the bias layer. For this reason, the forward flex was made great. The shaft had too great flexibility, and was not easy to swing. Since the bias sheet was not directly wound around the mandrel in comparative example 5, the end sticking of the bias sheet could not be performed by the tacking resin. Therefore, the unwinding was apt to occur. The unwinding reduces the winding workability, and increases the winding fault.

Since the low RC layer did not exist in comparative example 6, the shaft was made heavy. For this reason, the easiness of swing was reduced.

As described above, the advantages of the present invention are apparent.

Examples of commercially available prepregs are shown in Table 11. Resin contents described in Table 11 are reported from prepreg manufacturers. These resin contents are applied to the present application.

TABLE 11

Examples of commercially available prepregs

| Manufacturer | Part number of prepreg | Thickness of sheet (mm) | Fiber content (% by mass) | Resin content (% by mass) | Property value of carbon fiber: Part number of carbon fiber | Tensile elastic modulus ($t/mm^2$) | Tensile strength ($kgf/mm^2$) |
|---|---|---|---|---|---|---|---|
| Toray Industries, Inc. | 3255S-10 | 0.082 | 76 | 24 | T700S | 23.5 | 500 |
| Toray Industries, Inc. | 3255S-12 | 0.103 | 76 | 24 | T700S | 23.5 | 500 |
| Toray Industries, Inc. | 3255S-15 | 0.123 | 76 | 24 | T700S | 23.5 | 500 |
| Toray Industries, Inc. | 805S-3 | 0.034 | 60 | 40 | M30S | 30 | 560 |
| Toray Industries, Inc. | 2255S-10 | 0.082 | 76 | 24 | T800S | 30 | 600 |
| Toray Industries, Inc. | 2255S-12 | 0.102 | 76 | 24 | T800S | 30 | 600 |
| Toray Industries, Inc. | 2255S-15 | 0.123 | 76 | 24 | T800S | 30 | 600 |
| Toray Industries, Inc. | 2256S-10 | 0.077 | 80 | 20 | T800S | 30 | 600 |
| MITSUBISHI RAYON CO., LTD. | TR350C-100S | 0.083 | 75 | 25 | TR50S | 24 | 500 |
| MITSUBISHI RAYON CO., LTD. | TR350C-125S | 0.104 | 75 | 25 | TR50S | 24 | 500 |
| MITSUBISHI RAYON CO., LTD. | TR350C-150S | 0.124 | 75 | 25 | TR50S | 24 | 500 |
| MITSUBISHI RAYON CO., LTD. | MR350C-075S | 0.063 | 75 | 25 | MR40 | 30 | 450 |

TABLE 11-continued

| Examples of commercially available prepregs | | | | | | | |
|---|---|---|---|---|---|---|---|
| | | | | | Property value of carbon fiber | | |
| Manufacturer | Part number of prepreg | Thickness of sheet (mm) | Fiber content (% by mass) | Resin content (% by mass) | Part number of carbon fiber | Tensile elastic modulus (t/mm$^2$) | Tensile strength (kgf/mm$^2$) |
| MITSUBISHI RAYON CO., LTD. | MR350C-100S | 0.085 | 75 | 25 | MR40 | 30 | 450 |
| MITSUBISHI RAYON CO., LTD. | MR350C-125S | 0.105 | 75 | 25 | MR40 | 30 | 450 |
| MITSUBISHI RAYON CO., LTD. | MR350E-100S | 0.093 | 70 | 30 | MR40 | 30 | 450 |
| MITSUBISHI RAYON CO., LTD. | HRX350C-075S | 0.057 | 75 | 25 | HR40 | 40 | 450 |
| MITSUBISHI RAYON CO., LTD. | HRX350C-110S | 0.082 | 75 | 25 | HR40 | 40 | 450 |

Tensile strength and tensile elastic modulus are values measured based on JIS R 7601: 1986 "carbon fiber test method".

The method described above can be applied to the golf club shaft.

The description hereinabove is merely for an illustrative example, and various modifications can be made in the scope not to depart from the principles of the present invention.

What is claimed is:

1. A golf club shaft comprising a plurality of layers, wherein the layers comprise a straight layer in which an absolute angle θa of a fiber to a shaft axis line is equal to or less than 10 degrees, a bias layer in which the angle θa is 30 degrees or greater and 60 degrees or less, and a hoop layer in which the angle θa is equal to or greater than 80 degrees;

the layers comprise full length layers disposed all over in a longitudinal direction of a shaft, and a partial layer partially disposed in the longitudinal direction of the shaft;

the full length layers comprise full length bias layers as the bias layer, and full length straight layers as the straight layer;

the full length bias layers are located on the innermost side among the full length layers;

the full length layer brought into contact with a low RC full length layer outside the full length bias layers is a high RC layer;

the full length layer brought into contact with an outer surface of the full length bias layers is a high RC layer;

wherein the high RC layer is a layer formed by a prepreg having a resin content equal to or greater than 24% by mass; and the low RC layer is a layer formed by a prepreg having a resin content equal to or less than 20% by mass.

2. The shaft according to claim 1, wherein all the full length bias layers are the low RC layers.

3. The shaft according to claim 2, wherein a resin content of at least one layer of the full length straight layers is lower than a resin content of the full length bias layers.

4. The shaft according to claim 1, wherein a ratio of the low RC layer is equal to or greater than 50% by mass based on a mass of the shaft.

5. The shaft according to claim 1, wherein a mass of the shaft is equal to or less than 45 g.

6. The shaft according to claim 1, wherein a high-low united sheet obtained by laminating a low RC prepreg and a high RC prepreg is used.

7. The shaft according to claim 6, wherein the high-low united sheet is wound with the high RC prepreg set to the inside.

8. The shaft according to claim 6, wherein the low RC prepreg forms the straight layer, and the high RC prepreg forms the hoop layer.

9. The shaft according to claim 1, wherein the outmost full length layer is the high RC layer.

10. The shaft according to claim 1, wherein when a difference between resin contents of the mutually abutting low RC full length layer and high RC full length layer is defined as D1, the difference D1 is equal to or greater than 15% by mass.

11. The shaft according to claim 6, wherein a difference between resin contents of the low RC prepreg and high RC prepreg in the high-low united sheet is defined as D2, the difference D2 is equal to or greater than 15% by mass.

* * * * *